US009711338B2

(12) United States Patent
Covey et al.

(10) Patent No.: US 9,711,338 B2
(45) Date of Patent: Jul. 18, 2017

(54) ION SOURCE FOR MASS SPECTROMETRY

(75) Inventors: Thomas R. Covey, Ontario (CA); Peter Kovarik, Ontario (CA)

(73) Assignee: DH Technologies Development Pte. Ltd., Singapore (SG)

( * ) Notice: Subject to any disclaimer, the term of this patent is extended or adjusted under 35 U.S.C. 154(b) by 464 days.

(21) Appl. No.: 13/819,084

(22) PCT Filed: Sep. 1, 2011

(86) PCT No.: PCT/IB2011/002011

§ 371 (c)(1),
(2), (4) Date: May 10, 2013

(87) PCT Pub. No.: WO2012/028940

PCT Pub. Date: Mar. 8, 2012

(65) Prior Publication Data

US 2013/0213150 A1 Aug. 22, 2013

Related U.S. Application Data

(60) Provisional application No. 61/379,196, filed on Sep. 1, 2010.

(51) Int. Cl.
*H01J 49/04* (2006.01)

(52) U.S. Cl.
CPC ..... *H01J 49/0422* (2013.01); *H01J 49/04* (2013.01)

(58) Field of Classification Search
CPC ..... H01J 49/04; H01J 49/165; H01J 49/0454; H01J 49/067; H01J 49/0422; H01J 49/044; H01J 49/0445; H01J 49/0468; H01J 49/401; G01N 30/7246; G01N 35/1095

See application file for complete search history.

(56) References Cited

U.S. PATENT DOCUMENTS

| | | | | |
|---|---|---|---|---|
| 5,103,093 | A | 4/1992 | Sakairi et al. | |
| 5,412,208 | A * | 5/1995 | Covey et al. | 250/288 |
| 5,725,153 | A * | 3/1998 | Wang et al. | 239/102.1 |
| 6,797,945 | B2 * | 9/2004 | Berggren et al. | 250/288 |
| 7,091,477 | B2 * | 8/2006 | Jolliffe et al. | 250/282 |
| 8,153,964 | B2 * | 4/2012 | Chen et al. | 250/288 |
| 2004/0206910 | A1 * | 10/2004 | Lee et al. | 250/397 |

(Continued)

OTHER PUBLICATIONS

Publication of International Search Report for PCT/IB2011/002011 mailed Jun. 6, 2012.

(Continued)

*Primary Examiner* — Natalie Huls

(57) ABSTRACT

Systems and methods for delivering a sample to a mass spectrometer are provided. In one aspect, the system can include a sample source for generating a sample plume entrained in a primary gas stream in a first flow direction at a first flow rate, and a gas source for generating a secondary gas stream along a second flow direction different from the first flow direction and at a second flow rate greater than the first flow rate. The sample source and the gas source can be positioned relative to one another such that the primary gas stream intersects the secondary gas stream so as to generate a resultant gas stream propagating along a trajectory different from said first and second direction to bring the sample to proximity of a sampling orifice of the mass spectrometer.

13 Claims, 22 Drawing Sheets

(56) References Cited

U.S. PATENT DOCUMENTS

| | | | | |
|---|---|---|---|---|
| 2005/0274905 | A1* | 12/2005 | Joyce et al. | 250/423 R |
| 2006/0169891 | A1* | 8/2006 | Collings et al. | 250/291 |
| 2007/0102634 | A1* | 5/2007 | Frey et al. | 250/288 |
| 2008/0067352 | A1* | 3/2008 | Wang | 250/288 |
| 2012/0228492 | A1* | 9/2012 | Franzen | 250/288 |

OTHER PUBLICATIONS

PCT Written Opinion of the International Searching Authority for PCT/IB2011/002011.

PCT International Preliminary Report on Patentability for PCT/IB2011/002011 issued Mar. 5, 2013.

* cited by examiner

ION SOURCE FOR MASS SPECTROMETRY

RELATED APPLICATIONS

This application is a national stage filing under 35 U.S.C. 371 of PCT/IB2011/002011 filed on Sep. 1, 2011, which designates the U.S. and which claims priority to U.S. provisional application No. 61/379,196 filed Sep. 1, 2010, the contents of which are incorporated herein by reference in their entireties.

FIELD

The present teachings relate to methods, systems and apparatus for directing a sample (e.g., an analyte of interest) to a sampling orifice of a mass spectrometer.

INTRODUCTION

Mass spectrometers allow detection, identification, and quantification of chemical entities in unknown samples. The chemical entities are detected as ions and hence a conversion of the chemical entities to charged ions occurs during the sampling process. Liquid samples are conventionally converted into gas phase by employing atomizers, nebulizers and/or electro sprayers, which can produce a plume directed to a sampling orifice of a mass spectrometer. For example, a liquid sample can be converted into a plurality of micro droplets entrained in a carrier gas. Often a desolvation step aimed at drying the sample droplets to enhance the release of the ionic species from the sample is also included in the ion generation process.

Conventional sampling techniques, such as those mentioned above, can suffer from a number of shortcomings. For example, the relatively low flow rate capacity of atomization processes can result in poor sample utilization and generally a lower ability to detect a compound of interest in a sample. It can further limit upstream application of techniques, such as liquid chromatography (LC) based processes, that can offer complementary selectivity to the mass spectrometer. Other techniques that are capable of operating at higher flow rates, such as gas-assisted nebulization, can result in spatial dilution of the sample (e.g., reduction in ion density) in front of the sampling orifice as well as reduced residency time.

Moreover, the use of a number of "liquid-to-droplet" conversion processes that do not produce a directed sample plume having a net velocity can lead to degradation of sampling efficiency and hence severely diminished mass spectrometer performance.

Even in conventional techniques that can overcome some of the above shortcomings, confining, moving, ionizing and drying a sample stream, e.g., a droplet stream, can pose challenges that can adversely affect the performance of a mass spectrometer.

Accordingly, there is a need for enhanced system, methods and devices for preparing and delivering a sample to a mass spectrometer.

SUMMARY

In one aspect, a system for directing a sample to a mass spectrometer is disclosed, which includes a sample source for generating a sample plume entrained in a primary gas stream in a first flow direction at a first flow rate, and a gas source for generating a secondary gas stream along a second flow direction different from the first flow direction and at a second flow rate greater than the first flow rate. The sample source and the gas source are positioned relative to one another such that the primary gas stream intersects the secondary gas stream, e.g., at an intersection region, so as to generate a resultant gas stream propagating along a trajectory different from said first and second direction to bring the sample to proximity of a sampling orifice of the mass spectrometer.

The intersection of the primary and the secondary streams can cause at least partial mixing of the gas streams and the sample. In this manner, the resultant gas stream can confine and propel the sample toward the sampling orifice of the mass spectrometer.

In some embodiments, the resultant gas stream can have a flow rate in a range of about 1 L/min to about 29 L/min. In some embodiments, the sample resides within the resultant gas stream for a time in a range of about 0.1 ms to about 10 ms before reaching the proximity of the sampling orifice.

In some embodiments, the mass spectrometer can include a longitudinal axis with the sampling orifice positioned on that axis. In some such embodiments, the intersection region is offset from the longitudinal axis of the mass spectrometer. Further, in some such embodiments, at least one of said first and second flow directions is oriented so as not to intersect the longitudinal axis of the mass spectrometer.

In some embodiments, the sample entering the mass spectrometer via the sampling orifice traverses the sampling orifice substantially long the longitudinal axis of the mass spectrometer.

In some embodiments, the first flow direction is substantially orthogonal to the second flow direction. In other embodiments, the first direction can form a angle less than 90 degrees relative to the second flow direction.

In some embodiments, each of the sample source and the gas source comprises an outlet port and the system further includes a chamber (e.g., a source enclosure) in communication with the sampling orifice of the mass spectrometer and the outlet ports of the sample source and the gas source for receiving said primary and secondary gas streams.

In some embodiments, the first flow direction is substantially aligned with a longitudinal axis of the sample source and the second flow direction is substantially aligned with a longitudinal axis of the gas source. In some embodiments, the longitudinal axis of the sample source and the longitudinal axis of the gas source are co-planar with the sampling orifice, where the sampling orifice can be positioned, e.g., on a longitudinal axis of the mass spectrometer. In some such embodiments, a minimum distance between the outlet port of the sample source and the longitudinal axis of the mass spectrometer is in a range of about 3 mm to about 50 mm. Further, in some such embodiments, a minimum distance between the longitudinal axis of the sample source and the sampling orifice is about 3 mm to about 8 mm. In some such embodiments, a minimum distance between the output port of the gas source and a putative plane orthogonal to the longitudinal axis of the mass spectrometer and containing the sampling orifice can be in a range of about 10 mm to about 80 mm, and a minimum distance between the longitudinal axis of the gas source and the sampling orifice can be in a range of about 0 mm to about 40 mm. In some embodiments, the longitudinal axis of the gas source is offset relative to the sampling orifice while in other embodiments, the longitudinal axis of the gas source is substantially aligned with the sampling orifice.

In some embodiments, the second flow rate (i.e., the flow rate of the secondary gas stream) is at least about 5 times greater that the first flow rate (i.e., the flow rate of the primary gas stream). For example, the second flow rate can be between about 5 times to about 15 times greater than the first flow rate. In one embodiment, the second rate is about 10 times greater than the first flow rate.

In some embodiments, the first flow rate is about 0.1 liters/minute (L/min) to about 5 L/min and the second flow rate is about 1 L/min to about 24 L/min. For example, the first flow rate can be about 1.5 L/min and the second flow rate can be about 12 L/min.

In some embodiments, the primary gas stream exits the sample source at a first average velocity and the secondary gas stream exits the gas source at a second average velocity, wherein the first average velocity is greater than said second average velocity. For example, the first average velocity can be at least about 8 times greater than the second average velocity. By way of example, in some embodiments, the first average velocity is in a range of about 50 m/s to about sonic expansion velocity (about 330 m/s) and the second average velocity is in a range of about 0 m/s to about 25 m/s.

In some embodiments, the gas source is configured to generate a heated gas for transferring heat to the sample for desolvation thereof. The heated secondary gas can have a temperature selected so as to optimize the desolvation of the sample along the trajectory taken by the resultant gas stream. By way of example, in some embodiments, the secondary gas stream can be a heated gas stream having a temperature in a range of about 30° C. to about 800° C.

In some embodiments, the sample source comprises a nebulizer for generating droplets of the sample entrained in the primary gas stream. Further, in some embodiments, such a sample source can include an electrospray ion source.

In some embodiments, the primary gas stream comprises any of $N_2$, air, and a noble gas (e.g., helium, neon, or argon), and the secondary gas stream comprises any of $N_2$, air and a noble gas.

In some embodiments, the sample can include electrically neutral species. In other embodiments, the sample can include electrically charged species. By way of example, the sample source can comprise an ionizer charging a liquid containing the sample delivered thereto.

In some embodiments, the system further includes a pair of electrodes adjacent the sample orifice that are configured to charge at least a portion of electrically neutral species contained in the sample portion that enters the sampling orifice.

In some embodiments, the above system can include a mechanism in thermal coupling with the outlet port of the sample source for controlling a temperature thereof. By way of example, the mechanism can be a fluid passage providing a conduit through which a fluid, e.g., a cooling fluid, can flow. In another example, the mechanism can include a source for generating any of a heating gas or a cooling gas and for directing the gas onto the outlet port of the sample source for heating or cooling thereof. In yet another example, the mechanism can include a source for directing a liquid onto the outlet port of the sample source to provide evaporative cooling of the outlet port.

In another aspect, a method for directing a sample to a mass spectrometer is disclosed, which comprises generating a sample entrained in a primary gas stream propagating along a first direction, generating a secondary gas stream propagating along a second direction different from the first direction so as to intersect the primary gas stream, thereby generating a resultant gas stream moving along a trajectory that brings the sample in proximity to a sampling orifice of the mass spectrometer, wherein a flow rate of the primary gas stream is less than a flow rate of the secondary gas stream and an average flow velocity of the primary gas stream is greater than an average flow velocity of the secondary gas stream.

In some embodiments, in the above method, the first and second propagation directions are substantially orthogonal.

In some embodiments, in the above method, the flow rate of the secondary gas stream is between about 5 times to about 15 times greater than the flow rate of the primary gas stream. For example, the flow rate of the secondary gas stream can be about 10 times greater than the flow rate of the primary gas stream. By way of example, the flow rate of the primary gas stream is in a range of about 0.1 L/min to about 5 L/min, and the flow rate of the secondary gas stream is in a range of about 1 L/min to about 24 L/min.

In some embodiments, in the above method, an average flow velocity of the primary gas stream is at least about 8 times greater than an average flow velocity of the secondary gas stream. By way of example, an average flow velocity of the primary gas stream can be in a range of about 50 m/s to about sonic expansion velocity (e.g., about 330 m/s). Further, in some embodiments, an average flow velocity of the secondary gas stream can be in a range of about 0 m/s to about 25 m/s.

In some embodiments, in the above method, the secondary gas stream is heated prior to its intersection with the primary gas stream. For example, the secondary gas stream can be heated to a temperature in a range of about 30° C. to about 800° C.

In some embodiments, in the above methods, the flow direction of the primary gas stream, i.e., the first direction, is orthogonal to a longitudinal axis of the mass spectrometer. In some embodiments, the flow direction of the secondary gas stream, i.e., the second direction, is parallel and offset relative to a longitudinal axis of the mass spectrometer. In some embodiments, this offset is equal to or less than about 40 mm.

In some embodiments, the above method further includes electrically charging the sample and/or the secondary gas stream.

In another aspect, a system for directing a sample to a mass spectrometer is disclosed, which includes a sample source for generating a sample plume having a substantially vanishing net velocity vector, and a gas source for generating a steering gas flow in a direction such that the gas interacts with the sample plume to generate a resultant gas flow confining the sample and propagating along a trajectory for delivering at least a portion of the sample to a sampling orifice of a mass spectrometer.

In some embodiments, the sampling orifice of the mass spectrometer is positioned downstream from the gas flow exiting the gas source. In some embodiments, the sampling orifice can be positioned on a longitudinal axis of the mass spectrometer.

In some embodiments, the gas flow is directed substantially along the longitudinal axis of the mass spectrometer, e.g., a central axis of the mass flow can be co-axial with the longitudinal axis of the mass spectrometer. In some other embodiments, the gas flow is offset from the longitudinal axis of the mass spectrometer. In some embodiments, the gas flow can be substantially orthogonal to the longitudinal axis of the mass spectrometer, e.g., the gas flow can be directed across the sampling orifice of the mass spectrometer.

In some embodiments, the gas source is configured to generate a heated gas for transferring heat to the sample in the resultant gas flow for desolvation thereof. By way of example, the heated gas can have a temperature in a range of about 30° C. to about 800° C.

In some embodiments, the gas source is configured to impart a rotational motion to the gas about a central propagation axis of the gas flow so as to generate a confining vortex for confining the sample plume.

In some embodiments, any of the sample plume and the steering gas can contain electrically charged species. For example, in some embodiments, the sample plume and the steering gas can contain electrically charged species of opposite polarity. In other embodiments, the sample plume and the steering gas can contain electrically charged species of like polarity. In some embodiments, the sample source is configured to ionize a sample delivered thereto, e.g., a liquid delivered via an inlet port, to generate a charged sample that can exit the sample source at a substantially vanishing net velocity vector. In some embodiments, the steering gas comprises electrically charged species configured to ionize the sample.

In some embodiments, the sample source is configured to generate said sample plume having a substantially vanishing net velocity vector via any one of a mechanical, an electromechanical, or a thermal evaporation mechanism. By way of example, the sample source can comprise any of a piezoelectric and a thermal nebulizer.

In some embodiments, the above system can further include a pair of electrodes disposed adjacent the sampling orifice, where the electrodes are configured to ionize at least a portion of the sample delivered to the sampling orifice.

In some embodiments, the above system can further include another gas source adapted to generate another gas flow for further propelling the sample plume along said trajectory.

In another aspect, a system for directing a sample to a mass spectrometer is disclosed, which includes a venturi chamber in fluid communication with a sampling orifice of a mass spectrometer, where the venturi chamber includes an inlet port and an outlet port. The system further includes a sample source for generating a sample plume having a substantially vanishing net velocity vector, where the sample source is positioned relative to the inlet port of the venturi chamber so as to deposit the sample plume in proximity of the inlet port of the chamber. The system also includes a source for generating a gas flow directed in a direction so as to pass in proximity of the outlet port of the venturi chamber so as to cause a lowering of pressure within the chamber, thereby drawing at least a portion of the sample through the inlet port into the chamber such that at least a portion of the sample drawn into the chamber enters the sampling orifice.

In some embodiments, the gas flow has a flow rate in a range of about 0.2 L/min to about 20 L/min, and average flow velocity in a range of about 1 m/s to about 330 m/s.

In another aspect, a method for directing a sample for mass spectrometry is disclosed, which includes generating a sample plume having a substantially vanishing net velocity vector, and directing a stream of a gas toward the sample plume to steer the sample plume along a trajectory for delivering at least a portion of the sample to a sampling orifice of a mass spectrometer.

In some embodiments, in the above method, the gas stream confines the sample as it steers the sample to said sampling orifice. By way of example, the gas stream can have a flow rate in a range of about 0.2 L/min to about 20 L/min.

In some embodiments, the above method further includes heating the gas to effect heating of the sample via heat transfer from the gas stream to the sample.

In some embodiments, the above method further includes electrically charging the gas to effect electrical charging of at least a portion of the sample via charge transfer from the gas stream to the sample.

In some embodiments, the above method further includes electrically charging the sample plume and the gas to effect a charge interaction between the sample plume and the gas stream.

In some embodiments, in the above method, the sample plume comprises an aerosol plume.

Further understanding of the invention can be obtained by reference to the following detailed description in conjunction with the associated drawings, which are described briefly below.

BRIEF DESCRIPTION OF THE DRAWINGS

A skilled person in the art will understand that the drawings, described below, are for illustration purposes only. The drawings are not intended to limit the scope of the Applicant's teachings in any way.

DETAILED DESCRIPTION

Those skilled in the art will understand that the methods, systems, and apparatus described herein are non-limiting exemplary embodiments and that the scope of the applicants' disclosure is defined solely by the claims. While the applicant's teachings are described in conjunction with various embodiments, it is not intended that the applicant's teachings be limited to such embodiments. On the contrary, the applicant's teachings encompass various alternatives, modifications, and equivalents, as will be appreciated by those of skill in the art. The features illustrated or described in connection with one exemplary embodiment may be combined with the features of other embodiments. Such modifications and variations are intended to be included within the scope of the applicants' disclosure.

Figure 1:
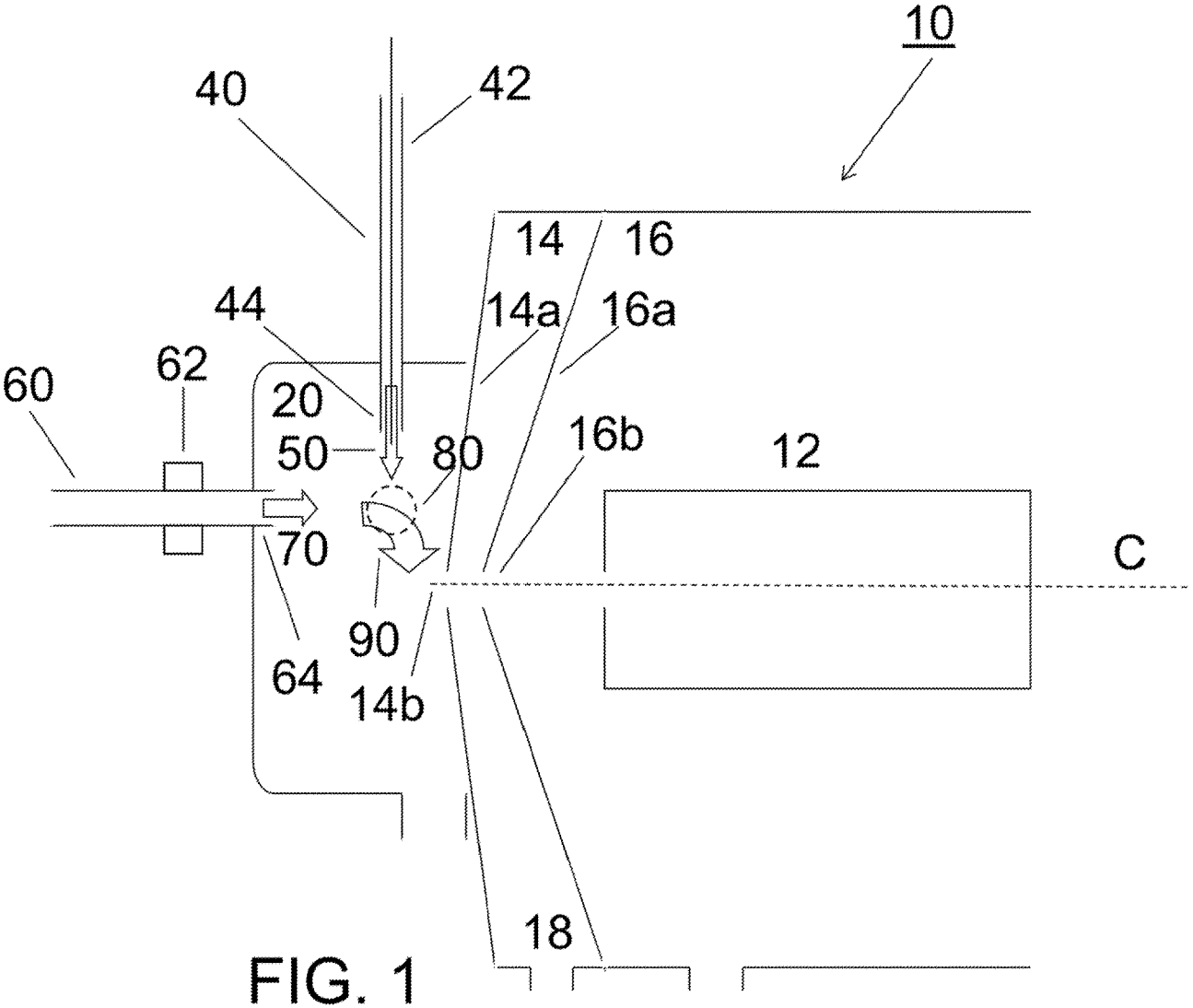
FIG. 1, in schematic diagram, illustrates an exemplary embodiment of system for delivering a sample to a mass spectrometer.

FIG. 1 schematically depicts an exemplary embodiment of a mass spectrometer system 10, which includes a system according to the applicant's teachings for delivering a sample to a sampling orifice of the mass spectrometer. The mass spectrometer system 10 can have a variety of configurations but generally is configured to receive a sample for mass spectrometric analysis in a downstream mass analyzer 12. As shown in FIG. 1, the mass spectrometer system 10 can include a sample source 40 for generating a sample, a source enclosure 20, a gas curtain chamber 14, and a vacuum chamber 16. The source enclosure 20 can be separated from the gas curtain chamber 14 by a plate 14*a* having a curtain plate aperture 14*b*, and the curtain chamber 14 can be separated from the vacuum chamber 16 by a plate 16*a* having a vacuum chamber sampling orifice 16*b*.

The vacuum chamber 16, which can be evacuated through a vacuum pump port 18, can enclose a commercially available mass analyzer 12. By way of non-limiting example, the mass analyzer 12 can be a triple quadruple mass spectrometer, or any other mass analyzer known in the art and modified in accord with the teachings herein. Ions from the source enclosure 20 can be drawn through orifices 14*a*, 14*b* positioned generally along the axis (C) of the mass spectrometer system 10 and can be focused (e.g., via one or more ion lens) into the mass analyzer 12. A detector at the end of the mass analyzer 12 can detect the ions which pass through the analyzer 12 and can, for example, supply a signal indicative of the number of ions per second which are detected.

As noted above, the system 10 depicted in FIG. 1 can include a sample source 40. The sample source 40 can have a variety of configurations but is generally configured to generate a sample to be analyzed by the mass analyzer 12. As will be appreciated by a person skilled in the art, the sample source 40 can receive an input containing the sample from a variety of sources, for example, an eluent containing the sample from a liquid chromatography column (not shown). As shown in FIG. 1, the sample source 40 can receive the liquid sample at its inlet port 42 and provide through its outlet port 44 to the source enclosure 20 a sample plume 50 containing the sample entrained in a gas stream (herein referred to as the "primary gas stream"). Use of the term "sample plume" herein is consistent with its common meaning in the art to refer to a quantity of a sample confined within a spatial volume. For example, the sample source 40 can atomize, aerosolize, nebulize, or otherwise manipulate the input containing the sample to form a sample plume 50. A number of different devices known in the art and modified in accord with the teachings herein can be utilized as the sample source 40. By way of non-limiting example, the sample source 40 can be a nebulizer assisted electrospray device, chemical ionization device, or nebulizer assisted atomization device.

As discussed otherwise herein, the primary gas stream can exhibit a variety of characteristics that can be selected to optimize, for example, the sensitivity of the mass spectrometer system 10. For example, the primary gas stream 50 can exhibit a flow rate and/or average flow velocity that can be increased or decreased in accord with the teachings herein. In some embodiments, the primary gas stream 50 can exit the outlet port 44 of the sample source 40 at a flow rate of about 0.1 L/min to about 5 L/min, or at a flow rate of about 0.8 L/min to about 2.5 L/min. In some embodiments, the primary gas stream can exit the outlet port 44 of the sample source 40 at an average velocity in a range of about 50 m/s to about the speed of sonic expansion (e.g., about 330 m/s), or in a range of about 200 m/s to about 300 m/s. As will be appreciated by a person skilled in the art, the average velocity can be measured or computed as an average of the velocity of gas across a cross-sectional area of the exit aperture of the sample source 40, e.g., the outlet 44. While in some embodiments the primary gas stream can have a continuous flow, in other embodiments, a primary gas stream in the form of intermittent plumes of gas exiting the outlet port 44 can be utilized to deliver the sample to the sampling orifice.

The sample within the sample plume 50 can have a variety of forms suitable for downstream analysis by the mass analyzer 12, such as, droplets containing neutral particles, ions, or combinations thereof. In some embodiments, the sample source 40 can ionize the sample as the sample plume 50 is generated. By way of example, a capillary extending between the sample source inlet 42 and outlet 44 can extend into the sample enclosure 20. A portion of the capillary made of a conductive material can have a voltage source coupled thereto. A source of pressurized gas (e.g. nitrogen, air, or noble gas) can supply a high velocity nebulizing gas flow which nebulizes the fluid ejected from the outlet port 44 as the droplets are charged by the voltage applied to the capillary. The sample plume 50 (e.g., the nebulizing flow and the ionized sample) can then be directed into the source enclosure 20, which can be in fluid communication, via the curtain plate aperture 14*b*, with a sampling orifice 14*a* of the mass spectrometer. In the depicted embodiment, the source enclosure 20 can be maintained at an atmospheric pressure, though in some embodiments the source enclosure 20 can be evacuated to a pressure lower than atmospheric pressure.

The mass spectrometer system 10 can further include a gas source 60 for generating a stream of a gas (herein referred to as the "secondary gas stream") for interacting with the primary gas stream in the source enclosure 20. The gas source 60 can have a variety of configurations, but generally includes an outlet port 64 in fluid communication with the source enclosure 20 and through which the secondary gas stream 70 can be directed to the source enclosure 20. While in some embodiments, the secondary gas stream 70 can have a continuous flow, in other embodiments it can be in the form of intermittent plumes of gas exiting the outlet port 64 of the gas source 60.

As discussed otherwise herein, the secondary gas stream 70 can exhibit a variety of characteristics that can be selected to optimize, for example, the sensitivity of the mass spectrometer system 10 and/or its interaction with the primary gas stream 50 and/or the sample contained therein. For example, the secondary gas stream 70 can exhibit a flow rate and/or average flow velocity that can be increased or decreased in accord with the teachings herein. As will be discussed in detail below, in some embodiments, the secondary gas stream 70 can exhibit a high volumetric flow rate and low average flow velocity relative to that of the primary gas stream 50. In some embodiments, for example, the flow rate of the secondary gas stream 70 as it exits the outlet port 64 can be in a range of about 1 L/min to about 24 L/min, or in a range of about 8 L/min to about 15 L/min. In some embodiments, the flow rate of the secondary gas stream 70 can be at least about 5 times greater than the flow rate of the primary gas stream, or in a range of about 5 times to about 15 times greater than that of the primary gas stream. For example, the flow rate of the secondary gas stream 70 can be about 10 times greater than that of the primary gas stream 50. In one embodiment, for example, the flow rate of the secondary gas stream 70 can be about 12 L/min and the flow rate of the primary gas stream 50 can be about 1.5 L/min (i.e., the flow rate of the secondary gas stream 70 is about 8 times greater than that of the primary gas stream 50).

The secondary gas stream 70 generated by the gas source 60 can also exhibit a variety of average velocities. In some embodiments, for example, the velocity of the secondary gas stream 70 as it exits the outlet port 64 of the gas source 60 (i.e., an average of velocity of the gas across a cross-sectional area of an aperture of the outlet port 64) can be in a range of about 0.5 meters per second (m/s) to about 25 meters per second. As noted above, in some embodiments, the average velocity of the secondary gas stream 70 can be less than that of the primary gas stream 50. For example, the average velocity of the primary gas stream 50 can be at least 8 times greater than that of the secondary gas stream 70.

In some embodiments, the secondary gas stream 70 can be heated by the gas source 60 prior to its exit through the outlet port 66. For example, the secondary gas stream 70 can be heated to a temperature in a range of about 30° C. to about 800° C. As will be discussed in detail below, the heated gas of the secondary gas stream 70 can be effective to evaporate at least a portion of the liquid droplets in the primary gas stream 50 when the primary and secondary gas streams 50, 70 are mixed, which can result in concentrating the sample, increasing ion emission, or reducing sample wastage (e.g., by reducing sample contained within large droplets that are not transmitted into the mass analyzer 12). By way of non-limiting example, a heater 62 can be coupled to the gas source 60 to heat the secondary gas stream 70. For example, a heating coil can encircle the gas source 60 to heat the secondary gas stream 70.

The sample source 40 and gas source 60 can have a variety of configurations, but in some embodiments, the sample source 40 and gas source 60 can be positioned relative to one another such that the primary gas stream 50 generated by the sample source 40 intersects the secondary gas stream 70 generated by the gas source 60. As shown in FIG. 1, for example, the primary and the secondary gas streams 50, 70 can exit their respective outlet ports 46, 66 along first and second directions that are substantially perpendicular to one another. In other words, the net velocity vector of the primary gas stream 50 as it exits the sample source 40 can be substantially orthogonal to the net velocity vector of the secondary gas stream 70 as it exits the gas source 60. As will be discussed in detail below, the primary and secondary gas streams 50, 70 can intersect at an intersection region 80 to generate a resultant gas stream 90, which can propagate along a trajectory different from that of the primary and secondary gas streams 50, 70.

Figure 2A:
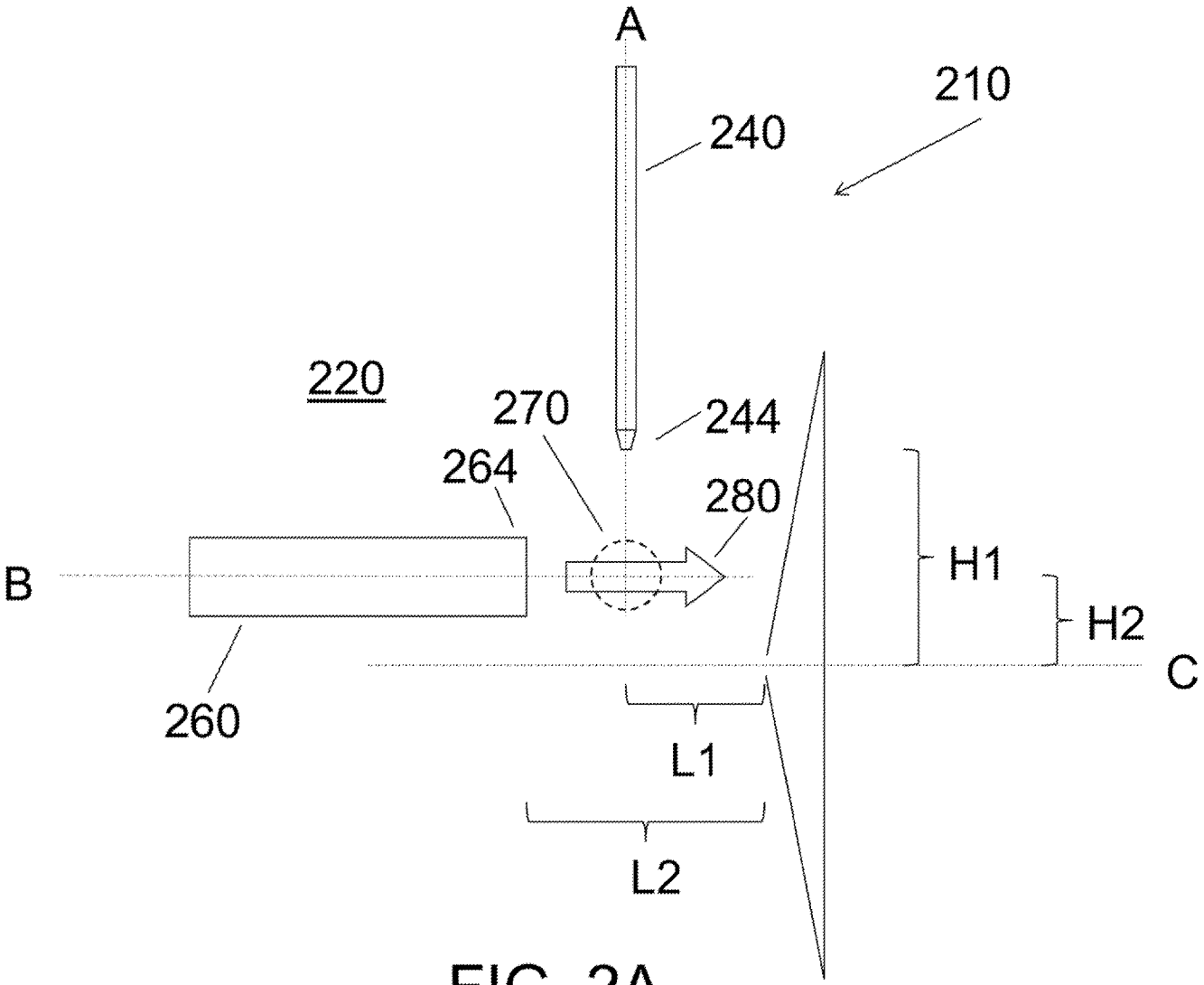
FIG. 2A, in schematic diagram, illustrates an exemplary embodiment of a system for delivering a sample to a mass spectrometer, depicting a secondary gas flow generated by a gas source.
Figure 2B:
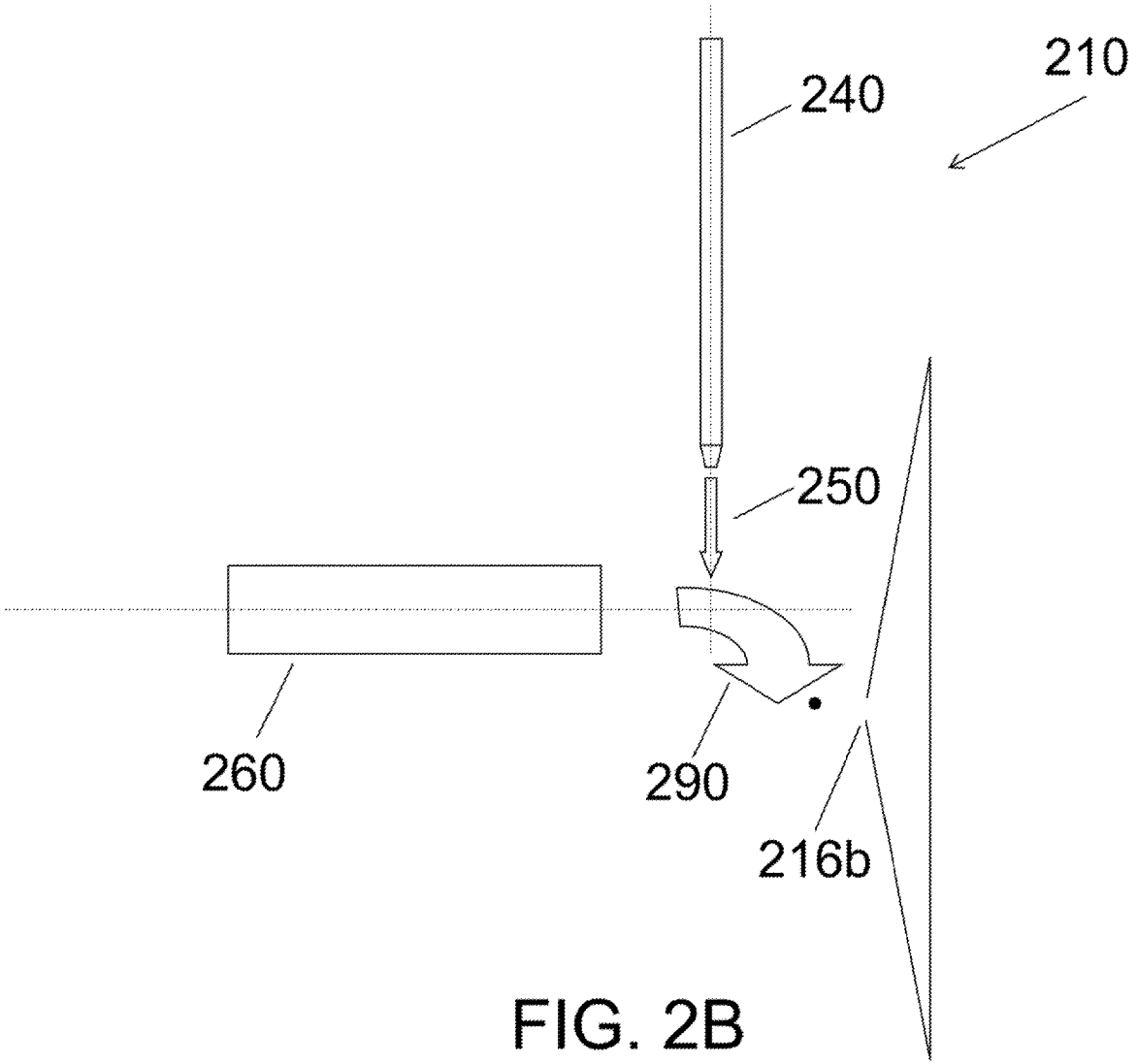
FIG. 2B, in schematic diagram, illustrates the system of FIG. 2A, depicting the interaction of the secondary gas flow with a primary gas flow.

For example, with reference now to FIGS. 2A and 2B, an exemplary system 210 is provided for delivering a sample to a sampling orifice of a mass spectrometer. The system 210, an exemplary implementation of a portion of the mass spectrometer system 10 of FIG. 1, can utilize a nebulizer probe 240 as the sample source. The nebulizer probe 240 can have a longitudinal axis (A) along which the primary gas stream 250 propagates. Similarly, the gas source 260 can have a longitudinal axis (B) along which the heated gas of the secondary gas stream 270 can propagate. As shown in FIG. 2A, the longitudinal axis (A) of the nebulizer probe 240 can be orthogonal to the longitudinal axis (B) of the gas source 260, though in other embodiments, different geometries can be employed. For example, the longitudinal axis (A) of the nebulizer probe 240 can form a non-orthogonal angle (e.g., an acute angle) relative to the longitudinal axis (B) of the gas source 260.

The sample source 240 and the gas source 260 can be arranged in a variety of manners but are generally positioned relative to one another such that the primary gas stream 250 carrying the sample and the secondary gas stream 260 can intersect at an intersection region 280, and thereby generate a resultant gas stream 290 within the source enclosure 220 to bring the sample to proximity of the sampling orifice 216*b*. As shown in FIG. 2B, the resultant gas stream 290 can move along a trajectory different from the initial propagation directions of each of the primary and secondary gas streams 250, 270. For example, in some embodiments, the secondary gas stream 270 can exit the gas source 260 as an elongated cloud that is co-axial and symmetrical about the longitudinal axis (B) of the gas source 260. The secondary gas stream 270 can collide with the primary gas stream 250 within the source enclosure 220 at an intersection region 280 located at a distance from the sampling orifice 216*b*. By way of non-limiting example, the intersection region 280 can be displaced from the sampling orifice 216*b* in a range of about 1 cm to about 10 cm, for example, from about 3 cm to about 6 cm, and from about 4 cm to about 5 cm. As will be discussed in detail below, the collision of the primary gas stream 250, which can have a lower flow rate than that of the secondary gas stream 270 but which moves at a greater velocity, can act to deflect the secondary gas stream 270 away from its initial propagation direction along the longitudinal axis (B) of the gas source 260. Additionally, the collision of the primary gas stream 250 with the secondary gas stream 270 can cause at least partial mixing of the two gas streams 250, 270 at the intersection region (280) and along the trajectory of the resultant gas stream 290 between the intersection region 280 and proximate the sampling orifice 216*b*. The interaction between the gas streams 250, 270 in the resultant gas stream 290 can result, for example, in heating and/or desolvation of the liquid droplets in the primary gas stream 250. The resultant gas stream 290 can have a variety of flow rates, for example, a flow rate in the range of about 1 L/min to about 29 L/min. In some embodiments, the sample can reside in the resultant gas stream (e.g., between the intersection point 280 and proximate the sampling orifice 216*b*) for a variety of times. By way of non-limiting example, the sample can reside within the resultant gas stream in a range of about 0.1 ms to about 10 ms.

As the resultant gas stream 290 approaches the sampling orifice 216*b*, at least a portion of the sample contained in the resultant gas stream 290 can be drawn into the sampling orifice 216*b* of the vacuum chamber 216.

As noted above, the sample source 240 and the gas source 260 can have a variety of arrangements, but are generally positioned relative to one another and relative to the sampling orifice 216*b* to effect delivery of the sample entrained within the resultant gas stream 290 to proximity of the sampling orifice 216*b*. In one embodiment, the sampling orifice 216*b* can be positioned on a longitudinal axis (C) of the mass spectrometer, and the longitudinal axes (A,B) of the sample source 240 and the gas source 260 can be substantially coplanar with the sampling orifice 216*b*. As shown schematically in FIGS. 2A and 2B, a minimum distance (L1), i.e., an orthogonal distance, between the longitudinal axis (A) of the sample source 240 and the sampling orifice 216*b* can be in a range of about 3 mm to about 8 mm. In some embodiments, for example, a minimum distance (H1), i.e., an orthogonal distance, between the output port 244 of the sample source 240 and the longitudinal axis (C) of the mass spectrometer containing the sampling orifice 216*b*, which extends through the sampling orifice 216*b* as depicted in FIGS. 2A and 2B, can be in a range of about 3 mm to about 50 mm. Further, a minimum distance (H2), i.e., an orthogonal distance, between the longitudinal axis of the gas source 260 and the sampling orifice 216*b* can be in a range of about 0 mm to about 40 mm. Further, a minimum distance (L2), i.e., an orthogonal distance, between the output port 264 of the gas source 260 and a putative plane orthogonal to the longitudinal axis (C) of the mass spectrometer and containing the sampling orifice 216*b* can be in a range of about 10 mm to about 80 mm.

As shown in FIGS. 2A and 2B, in an embodiment in which the longitudinal axis (B) of the gas source 260 is offset from the longitudinal axis (C) of the mass spectrometer extending through the orifice 216*b* (i.e., H2 is greater than 0 mm), the intersection between the primary gas stream 250 and secondary gas stream 270 can occur at an intersection region 280 that is also offset from the longitudinal axis (C) of the mass spectrometer. Further, in such an embodiment, the secondary gas stream 270 can propagate from the gas source 260 in a direction such that the secondary gas stream 270 does not intersect with the longitudinal axis (C) of the mass spectrometer. In other aspects, the gas source 260 can be positioned such that its longitudinal axis (B) does not intersect the longitudinal axis (C) of the mass spectrometer, though the resultant gas stream 290 can have a trajectory along a path between the intersection region 280 and proximate the sampling orifice 216*b* (e.g., in a direction that intersects the longitudinal axis (C) of the mass spectrometer).

In other embodiments, the sampling orifice 216*b* may not be positioned in a plane containing the longitudinal axes (A, B) of the sample source 240 and gas source 260, and/or the longitudinal axes (A, B) of the sample source 240 and gas source 260 may not be co-planar with one another. As will be appreciated by the person skill in the art, the above dimensions can be measured from each of the axes and/or the orifice relative to putative planes that contain the other axis and/or the orifice.

As discussed above, a ratio of the flow rate of the primary gas stream 250 to the flow rate of the secondary gas stream 270 in the embodiment depicted in FIGS. 2A and 2B can be in range of about 1:5 to about 1:15, for example, about 1:10. Further, the average velocity of the primary gas stream can be greater than the average velocity of the secondary gas stream. By way of example, the average flow velocity of the primary gas stream 250 can be at least 8 times greater than the average flow velocity of the secondary gas stream 270.

The above system for directing a sample to a mass spectrometer can provide a number of advantages over prior art systems, including those in which a gas stream containing the sample is mixed with heated gas directly adjacent the sampling orifice. For example, the parameters of the system 10 of FIG. 1 and system 210 of FIGS. 2A and 2B, for example, can be optimized, in a manner otherwise discussed herein, to balance the exposure of the micro-droplets containing the sample to heated gas of the secondary gas stream with the dispersion and/or scattering of the sample in the resultant gas stream having a trajectory along the path from the intersection region to proximate the sampling orifice. In this manner, the higher velocity, lower flow rate, primary gas stream can intersect and interact with the lower velocity, higher flow rate, secondary gas stream such that the resultant gas stream (and/or its flow characteristics) can be shaped and/or controlled, for example, by altering relative flow rates and velocities of the primary and secondary gas streams 250, 270, and/or relative positions of the sample source and gas source. This in turn can reduce losses due to dispersion and scattering during the sample's travel to the orifice, while maximizing residence of the sample in the heated gas. For example, the relative positions of the sample source and the gas source relative to one another and to the sampling orifice, as well as the flow rates and velocities of the primary and secondary gas streams, and the temperature of the heated gas can be selected in a manner discussed above so as to maximize the exposure of the sample to the heated gas to improve desolvation (e.g., evaporation of liquid in the droplets containing the sample) while minimizing the path length for the sample to reach the orifice.

In other words, unlike prior art systems in which the heater gas is typically adjusted for optimizing desolvation while the nebulizer gas is optimized for aerosol formation, the systems and methods described herein allow for the adjusting of multiple system parameters to achieve optimal performance (e.g., sensitivity). For example, as noted above, the flow rates and velocities of a heated secondary gas stream and a primary gas stream (e.g., nebulizer flow) can be selected to define a desired shape and trajectory of the resultant flow. Further, the temperature of the heater gas can be selected to optimize desolvation. Thus, the optimization of the interactions among the above parameters, rather than individual adjustment of the parameters without regard to their interactions, allows optimizing the system performance, e.g., via maximizing desolvation while concurrently minimizing the path length to the orifice of the mass spectrometer.

Referring now to FIGS. 3-6, in some embodiments, a heated secondary gas stream 270 can be directed close to the outlet port 244 of the sample source 240, e.g., the output tip of a nebulizer, to effectively confine and shape a sample plume exiting the sample source 240. Such proximity of the heated gas to the outlet port 244 of the sample source 240 can in some cases cause the overheating of the outlet port 244, which can result in unstable operation of a downstream mass analyzer and/or loss of signal. Thus, in some embodiments, mechanisms for actively controlling the temperature of a sample source 240 (e.g., the spray tip of a nebulizer) are provided so as to maintain, for example, the outlet port of the sample source and the ejected sample plume at a selected temperature. By way of example, in some embodiments, an active temperature control of a spray and nebulizer tip can offer improved utilization of desolvation heaters by allowing higher temperatures in the secondary gas stream.

Figure 3:
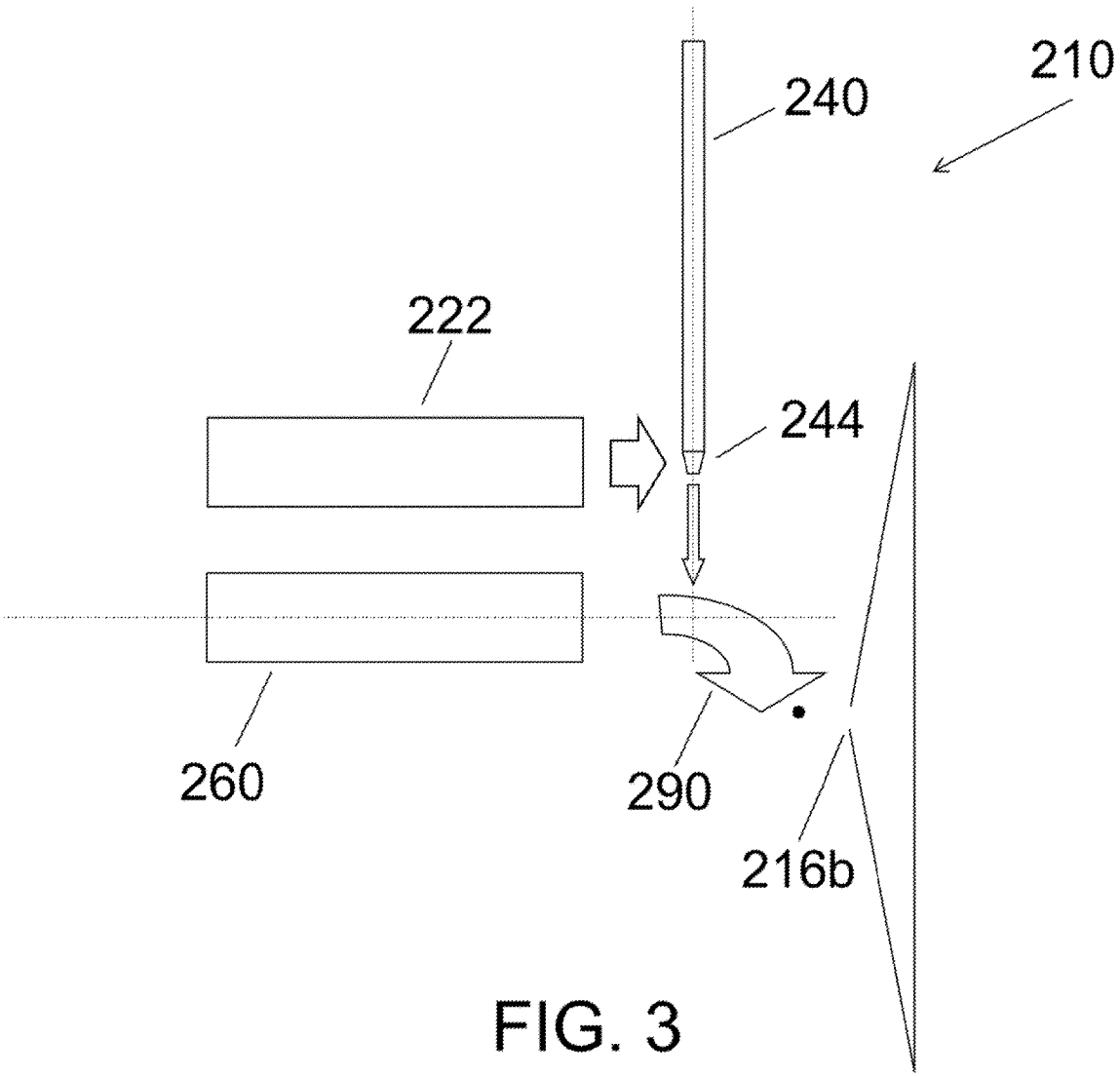
FIG. 3, in schematic diagram, illustrates the system of FIG. 2A having an exemplary embodiment of a cooling mechanism associated therewith.

By way of example, FIG. 3 schematically depicts a system according to an embodiment of the invention that includes, in addition to the elements discussed above in connection with the system 210 of FIGS. 2A and 2B, a source 222 for generating a cooling or heating gas and directing the gas onto the sample source 240, e.g. the output tip 244 of a nebulizer probe, to control the temperature of the sample source 240 and to actively maintain it at an optimal temperature. In some embodiments, the optimal temperature can be less than 60° C. Further, controlling the temperature of the nebulizer tip can also facilitate controlling the temperature of the sample plume exiting the nebulizer. In some embodiments, the cooling gas flow rate can range from about 0.5 L/min to about 3 L/min.

Figure 4:
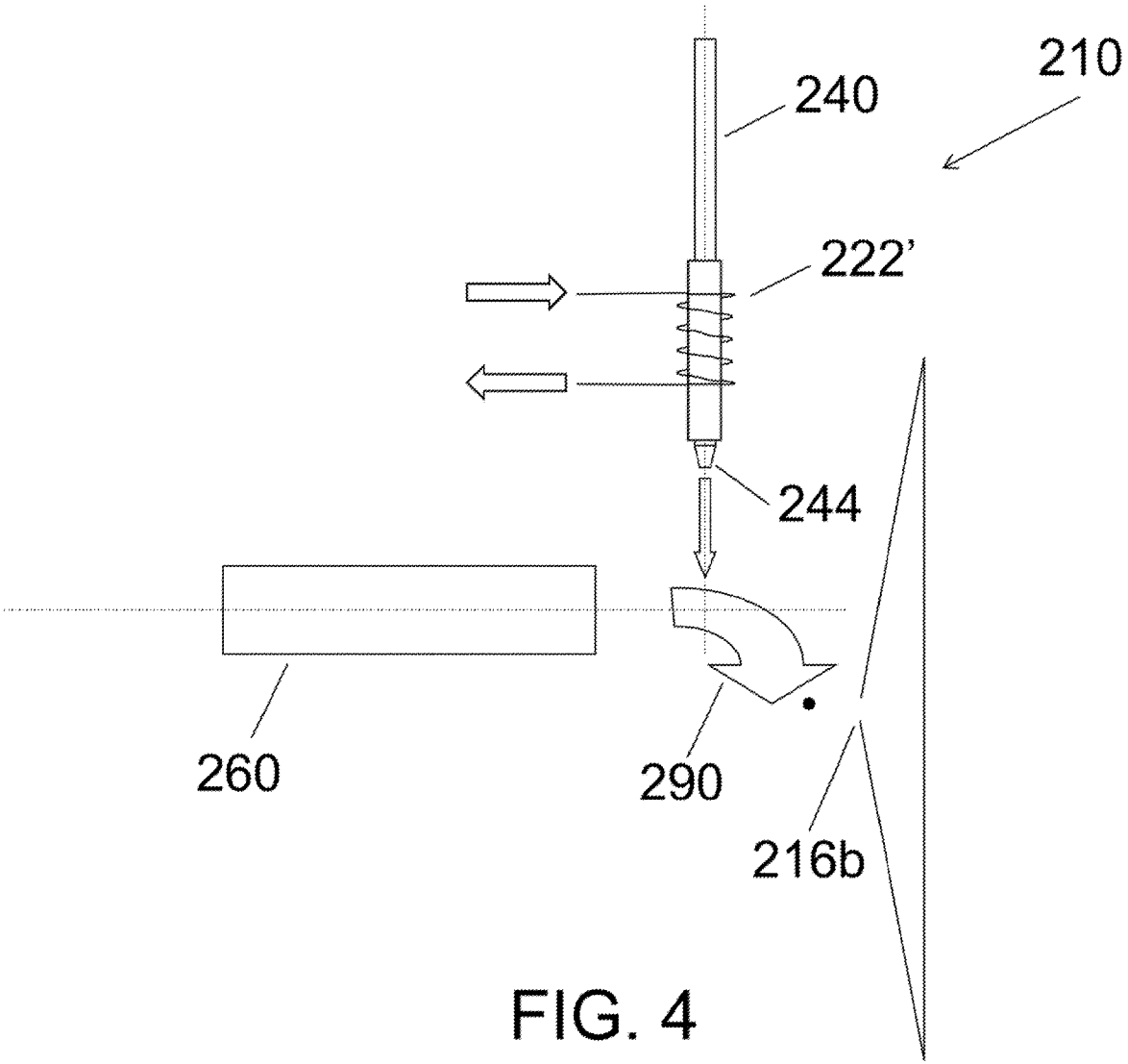
FIG. 4, in schematic diagram, illustrates the system of FIG. 2A having another exemplary embodiment of a cooling mechanism associated therewith.

FIG. 4 schematically depicts another embodiment in which a cooling jacket 222' is wrapped around the sprayer tip of a nebulizer 240 to be in thermal contact therewith. In one embodiment, the cooling jacket 222' can provide a fluid passage through which a cooling medium (e.g., chilled water) can flow. The cooling medium can extract heat from the nebulizer tip to maintain it at a desired temperature. The temperature of the cooling medium and its flow rate though the fluid passage can be selected to obtain a desired temperature of the nebulizer tip.

Figure 5:
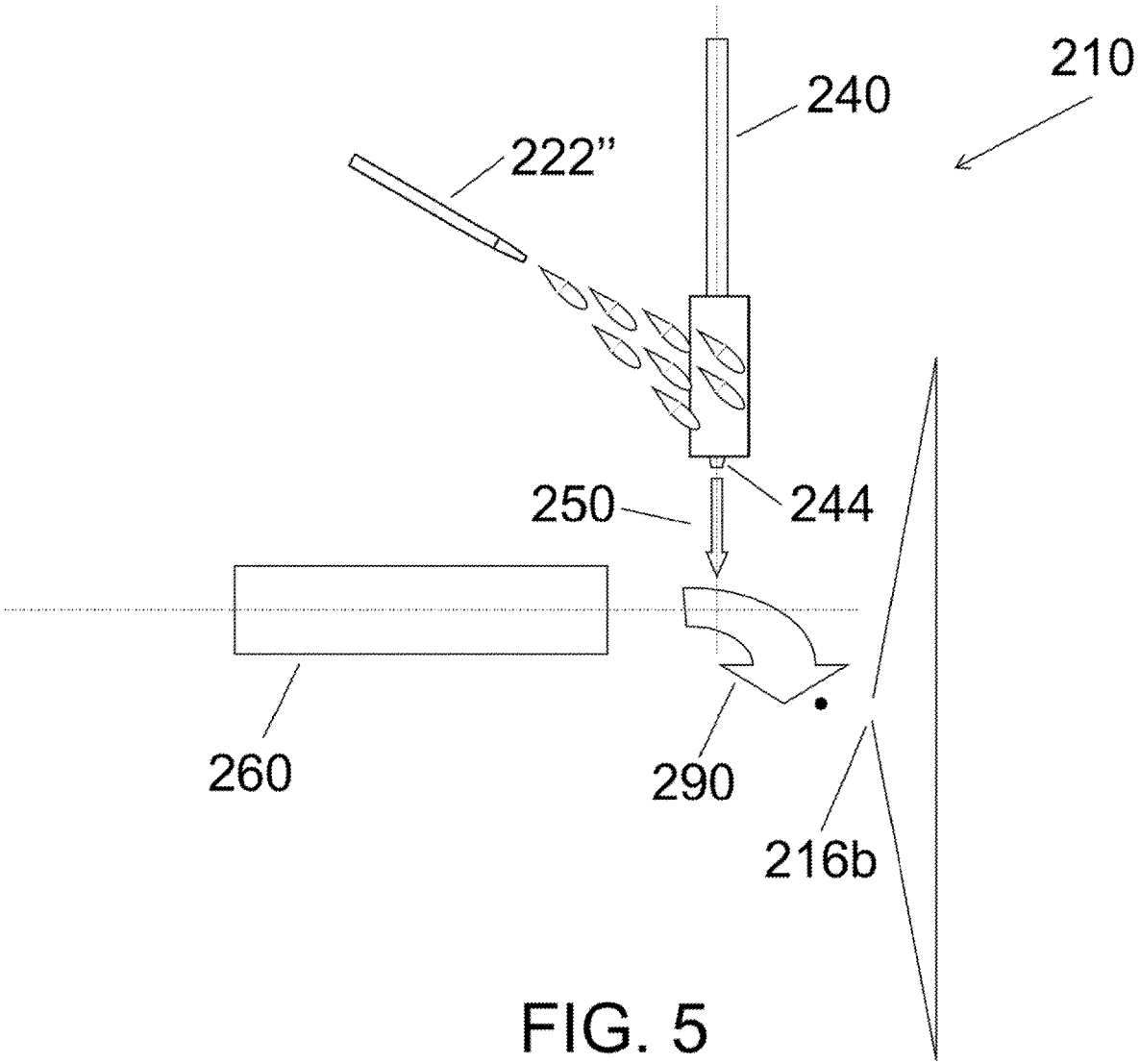
FIG. 5, in schematic diagram, illustrates the system of FIG. 2A having another exemplary embodiment of a cooling mechanism associated therewith.

FIG. 5 schematically depicts another embodiment in which a mechanism for cooling of the spray nebulizer tip 244 is employed. In this embodiment, the mechanism 222" can spray a cooling liquid onto the nebulizer 240. At least some of the liquid can evaporate upon contact with the nebulizer tip 244, thereby extracting heat therefrom.

Figure 6:
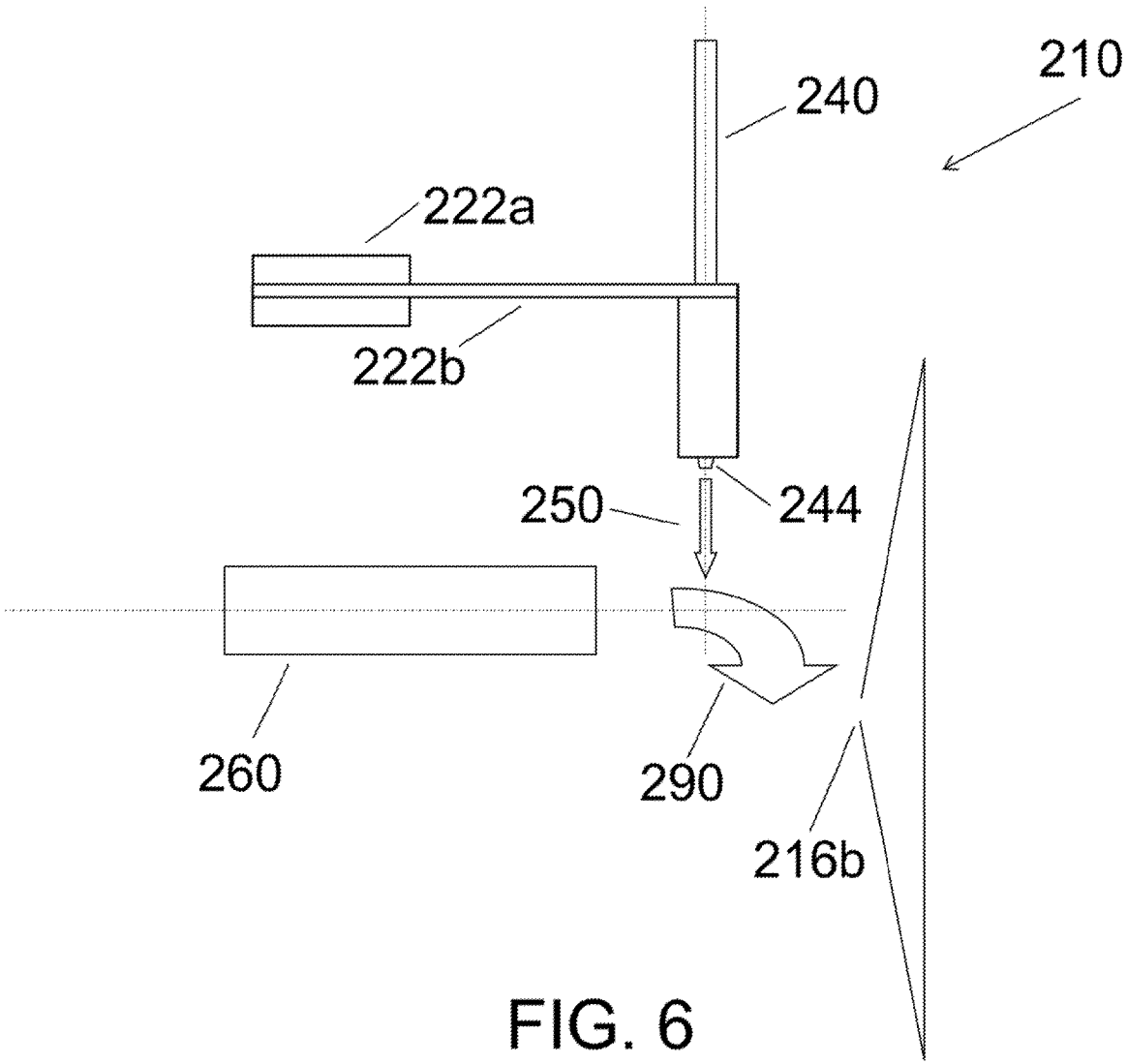
FIG. 6, in schematic diagram, illustrates the system of FIG. 2A having another exemplary embodiment of a cooling mechanism associated therewith.

By way of another example, FIG. 6 schematically depicts another embodiment in which a cooling mechanism, which includes a heat sink 222*a* remotely located from the nebulizer and a thermally conductive element 222*b* coupling the heat sink to the nebulizer tip 244, is employed for cooling the nebulizer 240. The thermally conductive element 222*b* can transfer heat from the nebulizer tip 244 to the heat sink 222*a* by thermal conduction or convection. By way of example, in some embodiments, the thermally conductive element can include a fluid passage through which a cooling fluid can be circulated between the nebulizer tip and the heat sink. In other embodiments, the thermally conductive element 222*b* can be a solid, e.g., a metal strip, having a high coefficient of thermal conductivity.

Examples

The applicants' teachings can be more fully understood with reference to the examples and resulting data that follow. Other embodiments of the applicants' teachings will be apparent to those skilled in the art from consideration of the present specification and practice of the present teachings disclosed herein. It is intended that these examples be considered as exemplary only. The examples are provided for illustrative purposes and do not necessarily indicate optimal ways of implementing applicant's teachings or optimal results that can be obtained.

Figure 7:
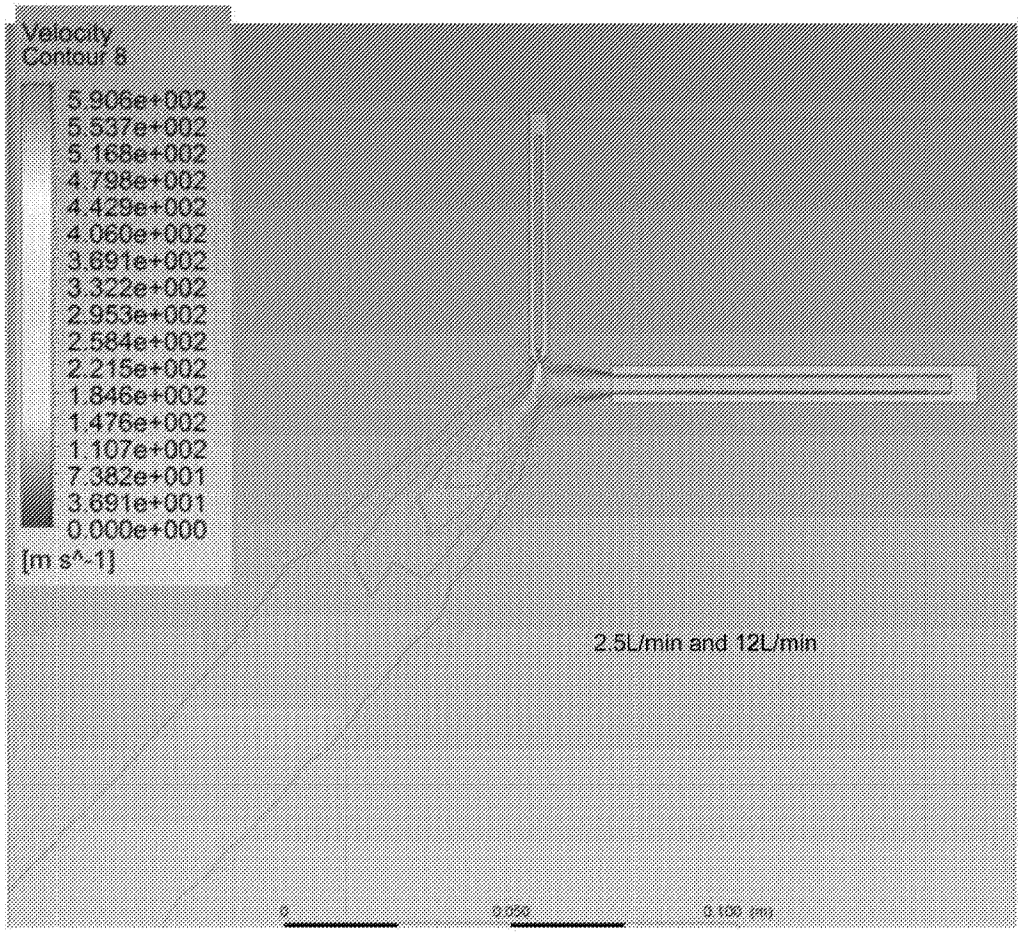
FIG. 7 presents data from a computational model of an exemplary embodiment of systems and methods for delivering a sample to a mass spectrometer.

A Computational Fluid Dynamics (CFD) model was used to theoretically study a system in which a relatively small volume of higher velocity gas was employed to deflect and shape a higher volume of lower velocity gas. More specifically, in a number of examples, the interaction of a small volume, low velocity nebulizer gas on a heater gas flow was modeled. Various primary and secondary gas velocities and flow ratios were considered, using as a model the apparatus depicted in FIG. 1, having the following dimensions: the outlet of the secondary gas source is 4 mm and is separated from the longitudinal axis of the sample source by 16 mm; the primary gas source has an internal diameter of 0.25 mm and is separated from the longitudinal axis of the gas source by 5 mm. FIG. 7 provides one example of a primary gas stream (e.g., a nebulizer gas stream) steering and/or shaping a secondary gas stream (e.g., a heater gas stream). In the depicted model, the primary gas stream and the secondary gas stream have a ratio of the flow rate of about 1:4.8 (i.e., the primary gas stream having a flow rate of 2.5 L/min and the secondary gas stream having a flow rate of 12 L/min). From viewing the effect of various flow rates and velocities of the primary and secondary gas streams on the shape and trajectory of the resultant gas stream, it was determined that a greater deflection of the secondary gas stream is generally obtained for higher ratios of the velocity of the primary gas stream relative to the secondary gas stream.

Figure 8:
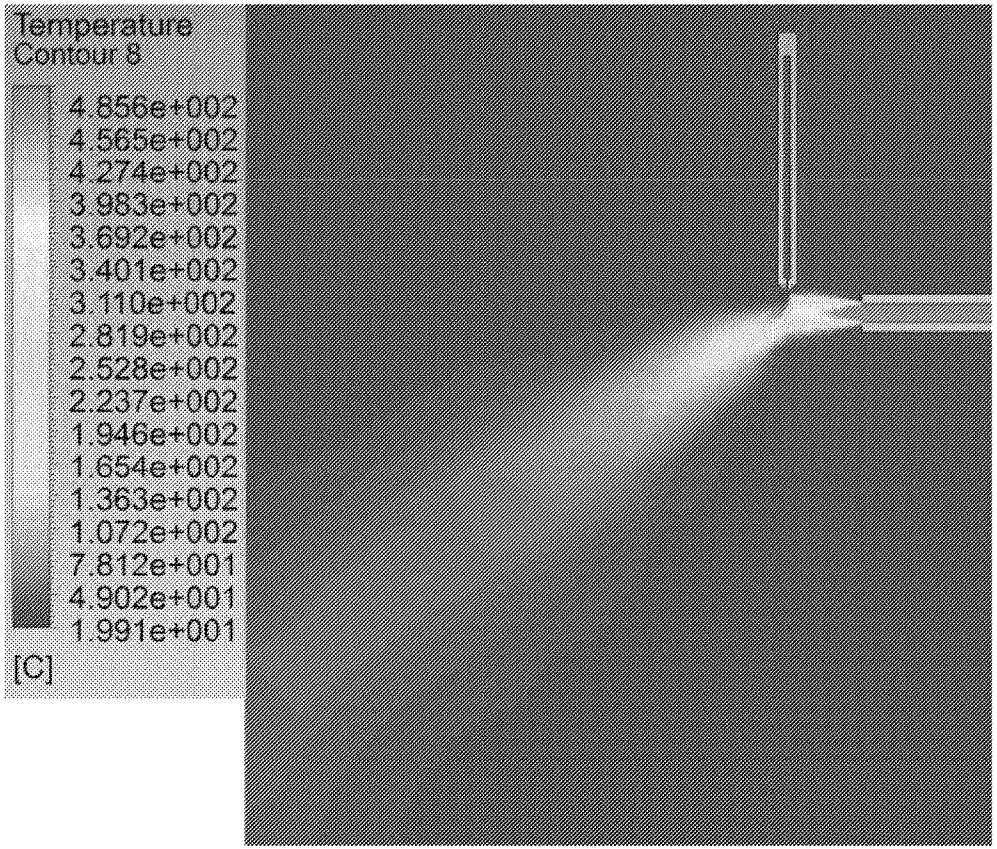
FIG. 8 presents data from a computational model of the system and method of FIG. 7.

In all cases, the resultant gas stream was well defined with a new shape, trajectory, and flow velocity, as shown by FIG. 8, which models the temperature profile of each of the gas streams. As noted above, a well-defined resultant gas stream whose shape can be controlled can provide an advantage for efficient sample desolvation, as the extended path length between the intersection region and the sampling orifice of the mass spectrometer can allow for increased interaction (e.g., overlap) between the primary gas stream and a heated secondary gas streams. The modeling data discussed above established that the overlap between the primary and secondary gas streams can be controlled so as to achieve optimal desolvation in the resultant gas stream. In particular, the deflection of the secondary gas stream and resulting interaction can be controlled such that a sample can spend an optimal amount of time in the resultant gas stream. For example, the resultant gas stream can be optimized such that the sample is neither overheated nor wet as it reaches the sampling orifice of the mass spectrometer.

Figure 9:
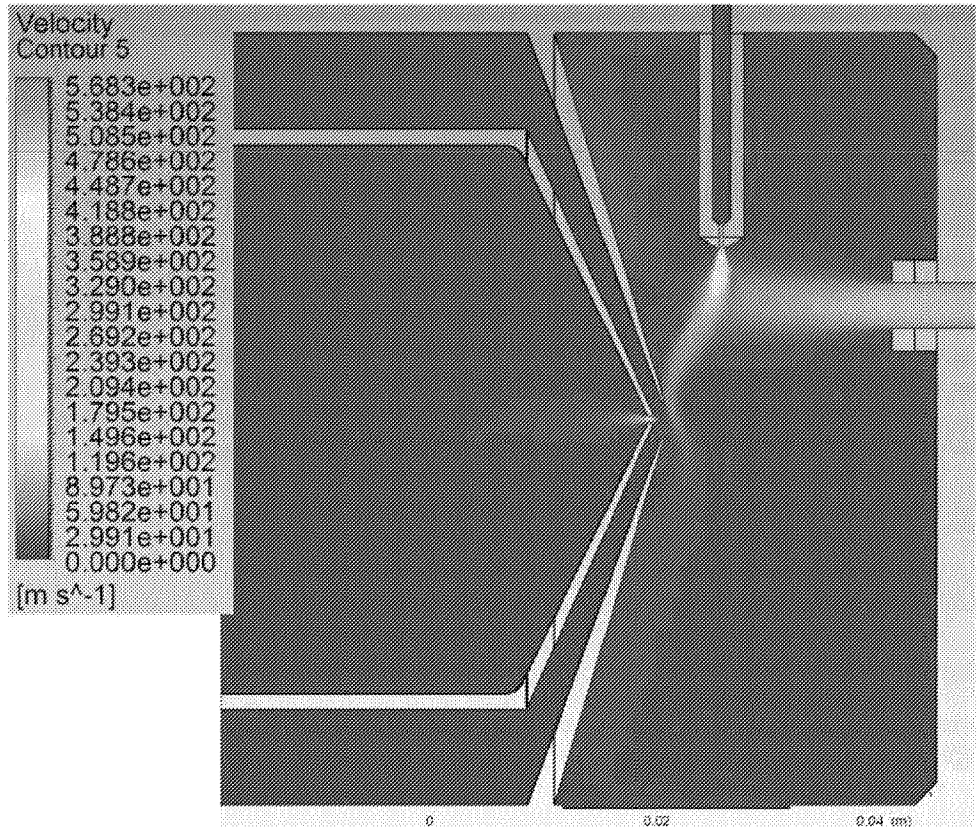
FIG. 9 presents data from an exemplary embodiment of a system and method for delivering a sample to a mass spectrometer according to applicant's teachings.

A prototype of the FIG. 9 CFD model was set-up to test the CFD predictions. In this configuration, a 4 mm ID (internal diameter) ceramic heater produced the low velocity secondary gas stream and an ESI-assisted nebulizer produced the primary gas stream. The flow rate of the liquid sample into the nebulizer ranged from 1 μL/min to 3 mL/min. The liquid sample was a water/methanol mixture ranging in composition from 90% to 10% water. Flow rates ranging from 0.1 L/min to 3 L/min for the primary gas stream and ranging from 1 L/min to 20 L/min for the secondary gas stream were tested, as well as the effect of various ratios between the two gas flow rates. An optimal ratio between the flow rate of the secondary gas stream relative to that of the primary gas stream was identified at about 10, with absolute flow rates being approximately 1

L/min and 10 L/min for the primary gas stream and the secondary gas stream, respectively.

Figure 10:
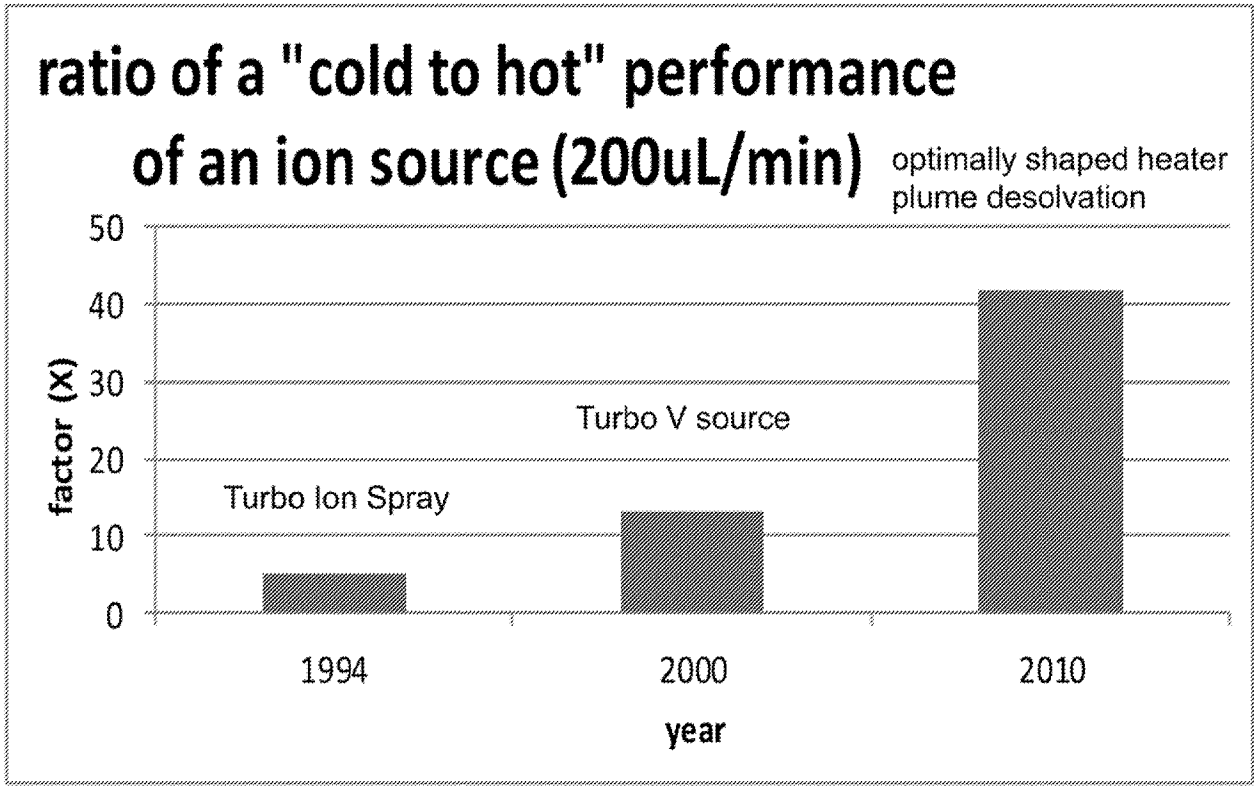
FIG. 10 presents performance data from one exemplary embodiment of a system and method for delivering a sample to a mass spectrometer according to applicant's teachings relative to commercially available systems.

The improved desolvation efficiency in systems and methods according to the teachings herein can result in improved detection of a sample by the mass analyzer as compared to prior art ion sources. For example, the above-described prototype employing an optimized resultant gas stream shows a significant performance improvement over the commercially available TurboIonSpray Ion Source™ (released in 2000) and the Turbo V Ion Source™ (released in 1994). The histogram depicted in FIG. 10 compares the detection signals generated by an API 4000 Qtrap™ mass spectrometer that employed a sample source (e.g., an ESI-assisted nebulizer operating at 200 μL/min of a liquid sample containing 50% water, 50% methanol, and 0.1% formic acid) based on applicant's teachings and the two previous generations of ion sources. More specifically, the histogram indicates the factor by which the signal was improved for each device when switched from a configuration without sample heating to a configuration in which desolvation of the sample was optimized. Whereas the TurboIonSpray Ion Source™ exhibited a gain of 5 and the Turbo V Ion Source™ exhibited a gain of about 12, an exemplary embodiment of a system and method in accord with applicant's teachings produced an increase of about 42 between cold (without heating) and hot (optimized desolvation) performance. Further, considering that the gain observed in a system in accord with applicant's teachings uses only a single heated gas source (as compared, for example, to the Turbo V Ion Source™ which utilizes two heaters), the improved performance of systems and methods in accord with applicant's teachings is further highlighted.

Figure 11A:
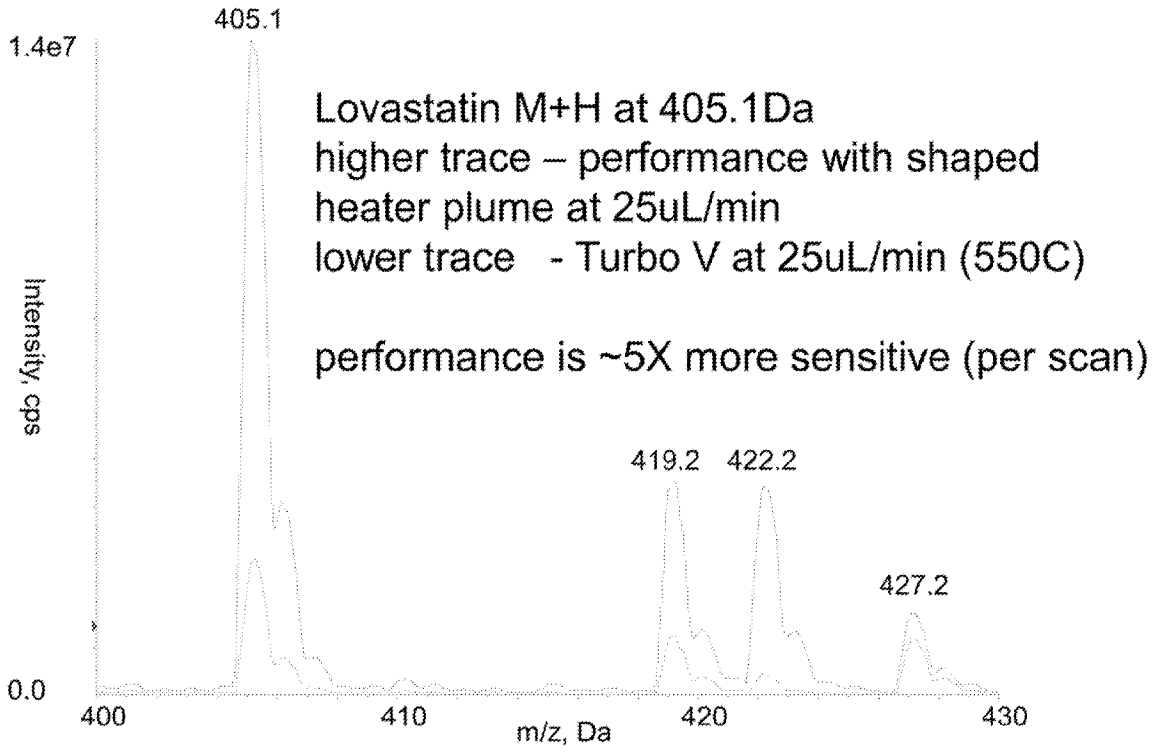
FIG. 11A presents mass spectrometric data using an exemplary embodiment of a system and method for delivering a sample to a mass spectrometer according to applicant's teachings relative to a commercially available system.
Figure 11B:
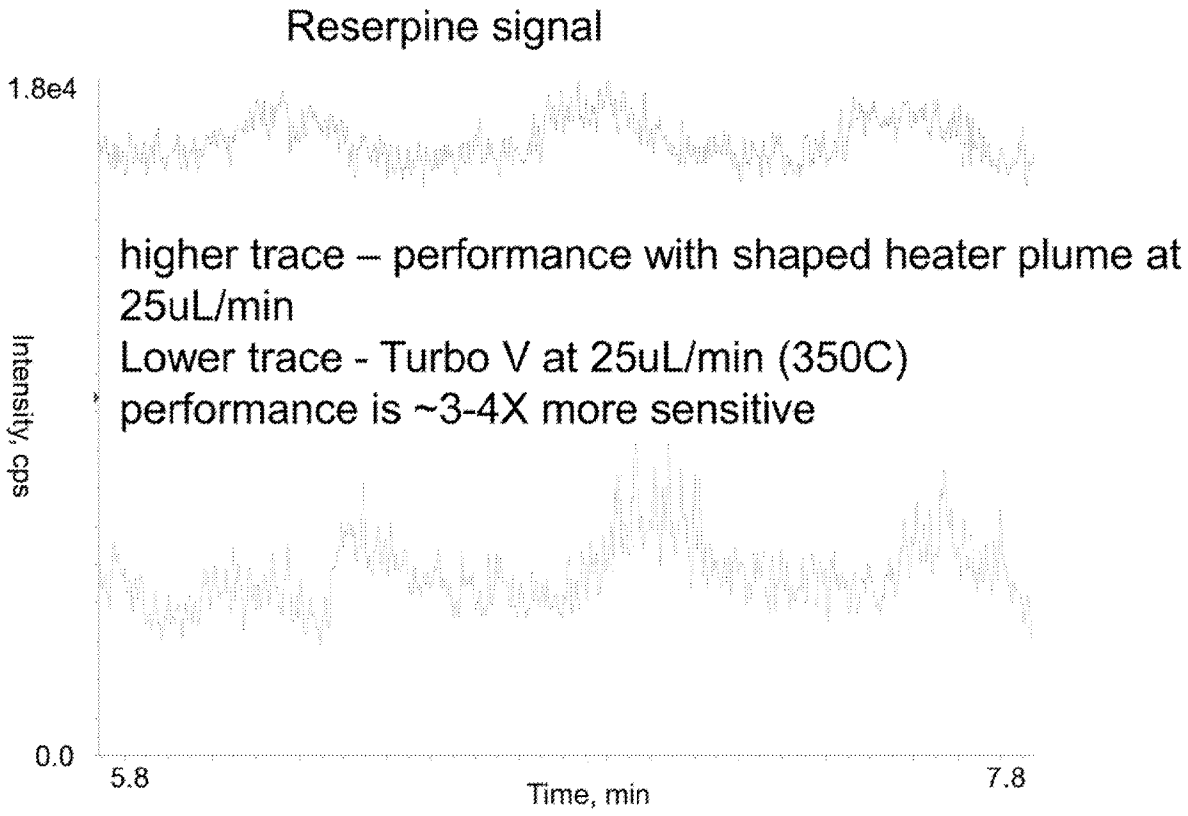
FIG. 11B presents mass spectrometric data using an exemplary embodiment of a system and method for delivering a sample to a mass spectrometer according to applicant's teachings relative to a commercially available system.
Figure 12:
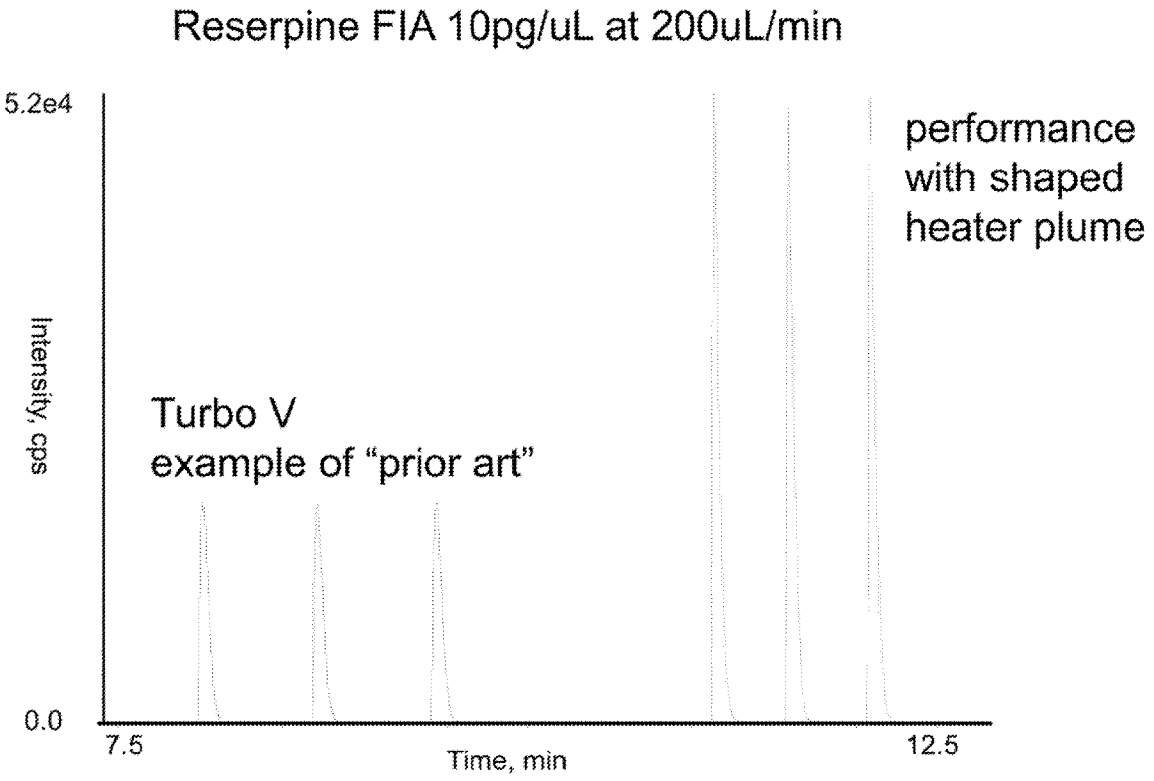
FIG. 12 presents mass spectrometric data using one exemplary embodiment of a system and method for delivering a sample to a mass spectrometer according to applicant's teachings relative to a commercially available system.
Figure 13:
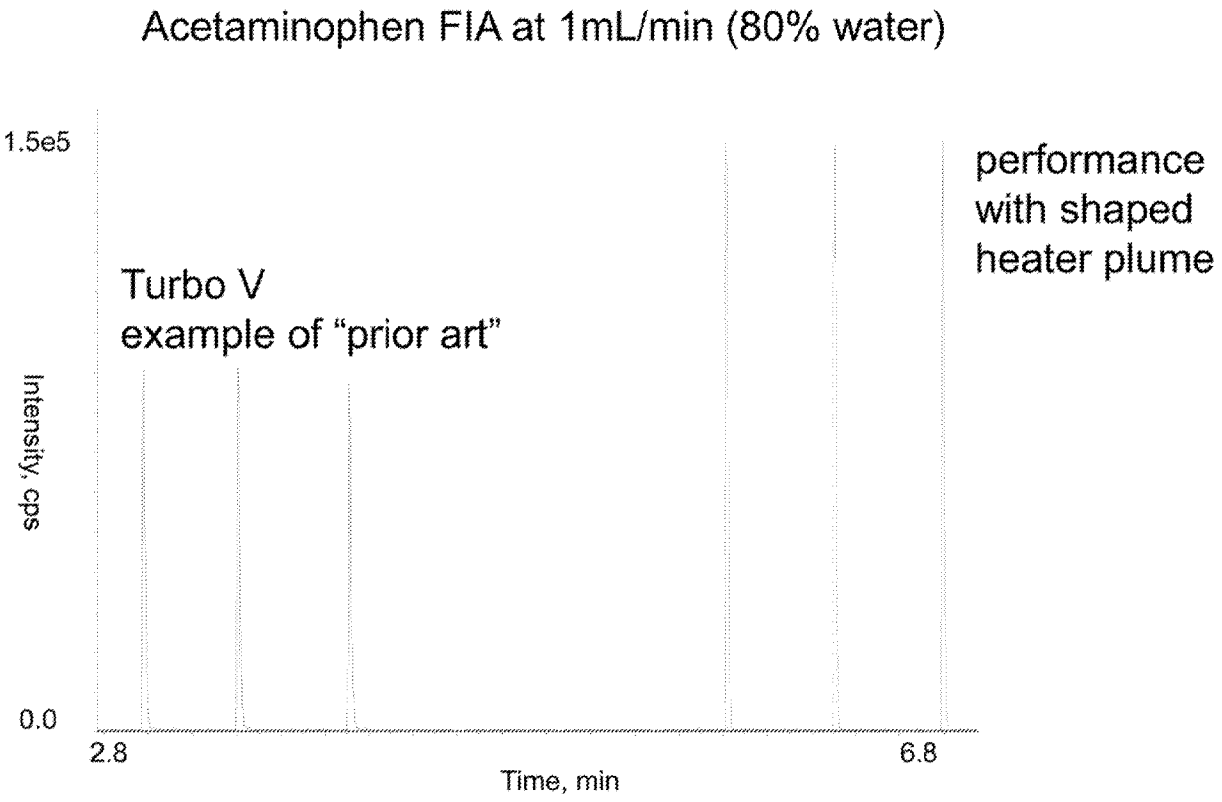
FIG. 13 presents mass spectrometric data using an exemplary embodiment of a system and method for delivering a sample to a mass spectrometer according to applicant's teachings relative to a commercially available system.

Without being limited to any particular theory, it is believed that systems and methods for delivering a sample to a mass spectrometer in accord with applicant's teachings can achieve a substantially higher desolvation efficiency, while minimizing the loss of sample due to dispersion and/or scattering. As demonstrated in FIGS. 11-13, the use of systems and methods in accord with applicant's teachings can result in significant gains in sample detection across the typical liquid sample delivery range of about 10 μL/min to about 3 mL/min. The variety of compounds tested demonstrates improvement in sample detection across the chemical space, as well as with different LC mobile phase composition, thereby demonstrating the applicability of applicant's teachings in sample elution under a variety of typical mass spectrometry and liquid chromatography/mass spectrometry conditions. With specific reference to FIG. 11A, for example, systems and methods in accord with applicant's teachings provided a five-fold improvement in sensitivity over an optimized Turbo V Ion Source™ in detecting lovastatin [M+H] contained within a sample delivered to the nebulizer at 25 μL/min. The liquid sample was delivered at a steady state rate of 25 μL/min (e.g., an infusion experiment), and detection was tuned to the protonated mass of the analyte while scanning a mass range from 400 Da to 430 Da in 0.5 sec with a step of 0.1 Da. Similarly, with reference to FIG. 11B, systems and methods in accord with applicant's teachings demonstrated a three-to-four-fold improvement in sensitivity over an optimized Turbo V Ion Source™ in detecting reserpine contained within a sample delivered to the nebulizer at 25 μL/min. FIG. 11B provides the results of an infusion experiment at a steady state flow rate of 25 μL/min of a solution containing the sample, with the detection being performed by targeted mass spectrometric analysis that monitored the precursor-fragment ion pair m/z transition of 609/195. Likewise, as shown in FIG. 12, for a 5 μL "plug" of a liquid sample containing 10 μg/μL repeatedly injected into a blank liquid stream being delivered to the nebulizer at 200 μL/min, systems and methods in accord with applicant's teachings demonstrated an average gain in sensitivity of about 2.5 relative to five Turbo V Ion Source™ operating under optimized conditions for the MRM transition 609/195. With reference now to FIG. 13, systems and methods in accord with applicant's teachings demonstrated a gain in sensitivity of about 1.3-1.4 in detecting acetaminophen contained within a 5 μL "plug" of a liquid sample containing 10 pg/μL of acetaminophen repeatedly injected into a blank liquid streamdelivered to the nebulizer at 1 mL/min. The MRM transition of 152/110 was monitored.

Whereas the above discussion focuses on the delivery of a sample entrained in a primary gas stream, which can have a high average velocity, in another aspect, systems and methods described herein can enable the delivery to a mass spectrometer of a sample plume generated at a substantially vanishing net velocity. As used herein, the term "substantially vanishing net velocity" is intended to a refer to a net velocity of motion (e.g., velocity of motion along a particular direction) that is less than about 10 cm/s, less than about 5 cm/s, less than about 1 cm/s, and in some cases zero.

Figure 14:
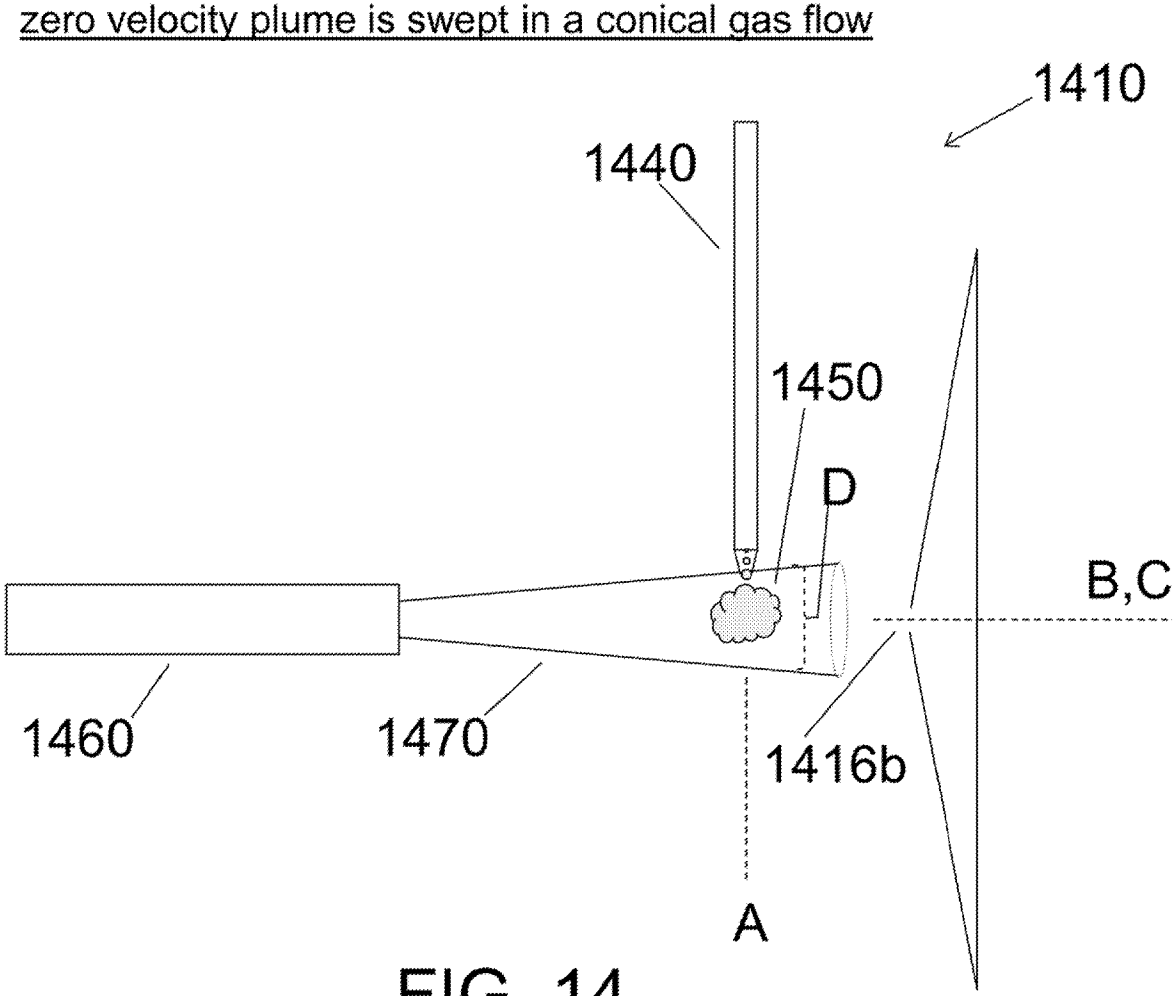
FIG. 14, in schematic diagram, illustrates an exemplary embodiment of a system for delivering a sample to a mass spectrometer.

FIG. 14 schematically depicts a system 1410 according to one such embodiment for delivering a sample to a mass spectrometer. The system 1410 includes a sample source 1440 for generating a sample plume 1450 at a substantially vanishing net velocity (herein also referred to as a "zero velocity plume"). By way of example, the sample source can employ mechanical, electromechanical, or thermal evaporation processes for generating the sample plume 1450. In various embodiments, the sample source 1440 can generate the sample plume 1450 without utilizing a gas flow that would impart a net velocity to the sample plume 1450. As such, the sample plume 1450 can leave the sample source 1440 with a very low, or in some cases, zero net velocity. In other words, while constituents of the sample plume 1450 can exhibit random thermal motion, the sample plume 1450 as a whole exhibits very low or even zero net velocity along any particular direction.

As shown in FIG. 14, the sample source 1440 can be a piezoelectric nebulizer that employs an electromechanical process for generating a sample plume at a substantially vanishing net velocity. In some embodiments, an aerosolized sample plume 1450 containing a plurality of microdroplets can be generated by rapidly varying a voltage to a material that exhibits expansion and contraction under application and removal of a voltage. The resulting high-frequency oscillation of the surface or mesh can break up an impinging liquid into a plurality of micro droplets. In other embodiments, other mechanisms can be utilized.

The system 1410 can further include a gas source 1460 for generating a gas stream 1470 (herein referred to as "steering gas stream") that exits an outlet 1464 of the gas source 1460 and is directed to the sample plume 1450. The steering gas stream 1470 can have a variety of configurations. For example, as shown in FIG. 14, the steering gas stream 1470 can diverge as it propagates toward the sample plume 1450 so as to form a conical steering gas stream 1470 having a cross-sectional diameter of the flow cone (D) at the sample that can be in a range of about 3 mm to about 30 mm. The steering gas stream 1470 can move the confined sample toward a sampling orifice 1416*b* of a mass spectrometer such that at least a portion of the sample enters the sampling orifice 1416*b*. As will be appreciated by a person skilled in the art, the gas source 1460 can be a variety of known gas sources such as a nitrogen/zero air generator or compressed gases such as $N_2$ and noble gases.

While in this embodiment the central flow direction of the steering gas stream 1470 is aligned with a longitudinal axis (C) of the mass spectrometer on which the sample orifice 1416*b* is positioned, in other embodiments, the central flow direction of the steering gas stream 1470 can form an angle relative to the longitudinal axis (C). In general, the orifice plate 1416 can have any orientation relative to the sample plume. Further, while in this embodiment, the steering gas stream 1470 exhibits a continuous flow, in other embodiments it can include intermittent gas plumes exiting the gas source.

In some embodiments, the flow rate of the steering gas stream 1470 as it exits the outlet 1464 of the gas source 1460 can be in a range of about 0.2 L/min to about 20 L/min, for example, in a range of about 0.3 L/min to about 15 L/min, or in a range of about 1 L/min to about 5 L/min. In some embodiments, the average velocity of the steering gas stream 1470 (i.e., an average of the gas velocity across an aperture of the outlet 1464 of the gas source 1460) can be in a range of about 0.5 m/s to about 330 m/s, for example, in a range of about 1 m/s to about 50 m/s.

In some embodiments, the gas source 1460 can also include a heater 1462 for heating the steering gas stream 1470 to an elevated temperature suitable for desolvation of the sample as the steering gas stream 1470 confines and steers the sample toward the sampling orifice 1416*b*. By way of example, the temperature of the steering gas, e.g., as it leaves the gas source 1460, can be in a range of about 30° C. to about 800° C.

The exemplary system 1410 depicted in FIG. 14 can be implemented by utilizing a variety of geometries for the positions and/or orientation of the sample source 1440, the gas source 1460 and the orifice 1416*b*. In the depicted embodiment, the sample source 1440, the gas source 1460, and the orifice plate 1416*b* include, respectively, longitudinal axes (A), (B), and (C) that can be co-planar. The minimum distance (L1), i.e., orthogonal distance, between the outlet port 1464 of the gas source 1460 and the longitudinal axis of (A) of the sample source 1440 can be in a range of about 1 mm to about 50 mm, and the minimum distance (H1), i.e., an orthogonal distance, between the outlet port 1444 of the sample source 1440 and the longitudinal axis (B) of the gas source 1460 can be in a range of about 1 mm to about 50 mm. Further, the minimum distance (L1), i.e., an orthogonal distance, between the sampling orifice 1416*b* and the longitudinal axis (A) of the sample source 1460 can be in a range of about 1 mm to about 50 mm.

Figure 15:
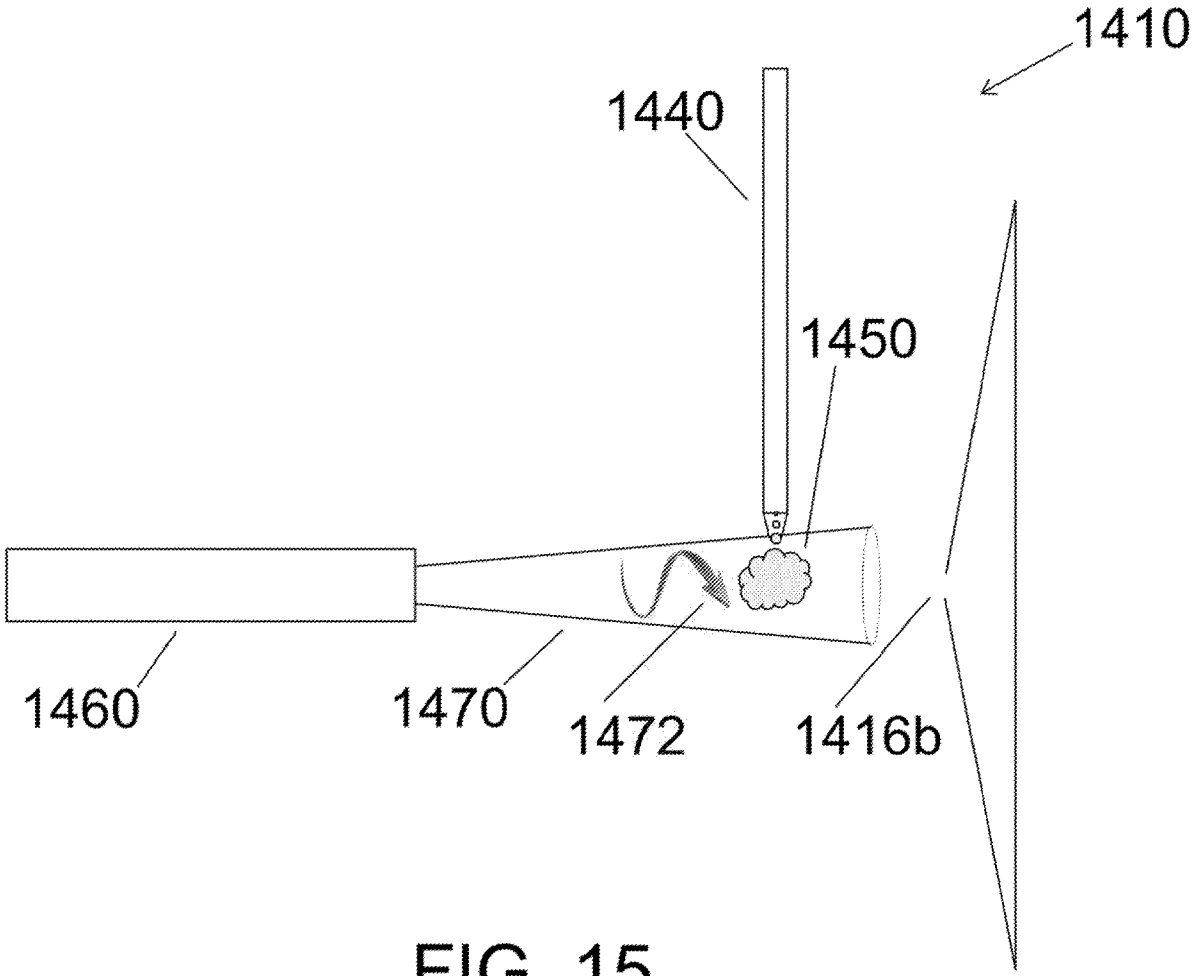
FIG. 15, in schematic diagram, illustrates a variant of the system of FIG. 14.

With reference now to FIG. 15, in some embodiments, the steering gas stream 1470 can exhibit rotational motion about the central axis of propagation (B) as it moves toward the sample plume 1450. In other words, the steering gas stream 1450 can exhibit a spin. Such rotational motion or spin can create a confining vortex 1472, which can prevent dispersion of the sample and further increase the residence time of the sample in front of the sampling orifice 1416*b*.

Figure 16:
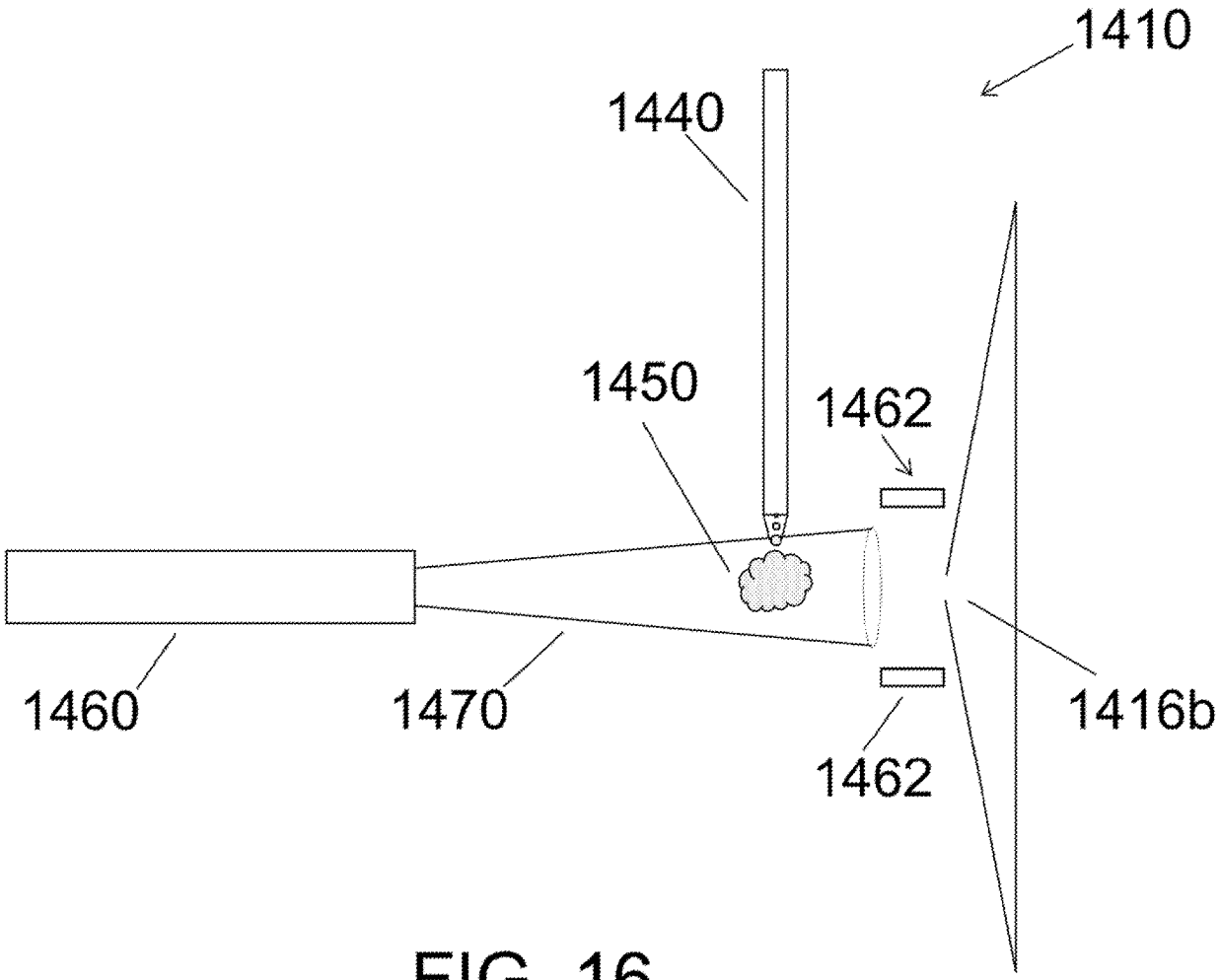
FIG. 16, in schematic diagram, illustrates a variant of the system of FIG. 14.

With reference now to FIG. 16, in some embodiments, the sample source 1440 can generate a sample plume 1450 that includes electrically charged species, e.g., ions. In some embodiments, the sample itself can be charged (e.g., ionized) by the source to enable downstream mass spectrometric analysis (e.g., by an induction electrode associated with the source). Additionally or in the alternative, the gas source 1460 can generate a steering gas stream 1470 that includes electrically charged species (e.g., by an induction electrode in its path). As shown in FIG. 16, the charged species in the sample plume 1450 can have an electrical charge having the same polarity as that of the charged species in the steering gas stream 1470 (i.e., they have like charges, e.g., both positive or both negative). Like charges on the steering gas stream 1470 and the sample plume 1450 can increase interaction between the steering gas stream 1470 and the sample, which could result in less required steering gas flow volume and ultimately less dilution. In some embodiments, charged species in the sample plume 1450 and those in the steering gas stream 1470 can have electrical charges of opposite polarity (e.g., negative ions in the sample plume 1450 and positive ions in the steering gas stream 1470 or vice versa). While such opposite charges may lead to neutralization, they can, in some cases, improve the mixing of the sample into the steering gas stream 1470 and enhance the ability of the steering gas stream 1470 to "drag" the sample to the orifice. In some embodiments, ions within the steering gas stream can be effective to charge (e.g., ionize) the sample to enable downstream mass spectrometric analysis. Further, in some embodiments, a pair of electrodes 1462 disposed adjacent the sampling orifice can charge or modify the charge of molecules of the sample entering the sampling orifice 1416*b*. For example, in some embodiments, the electrodes 1462 can charge an electrically neutral species contained in the sample entering the sampling orifice.

Figure 17:
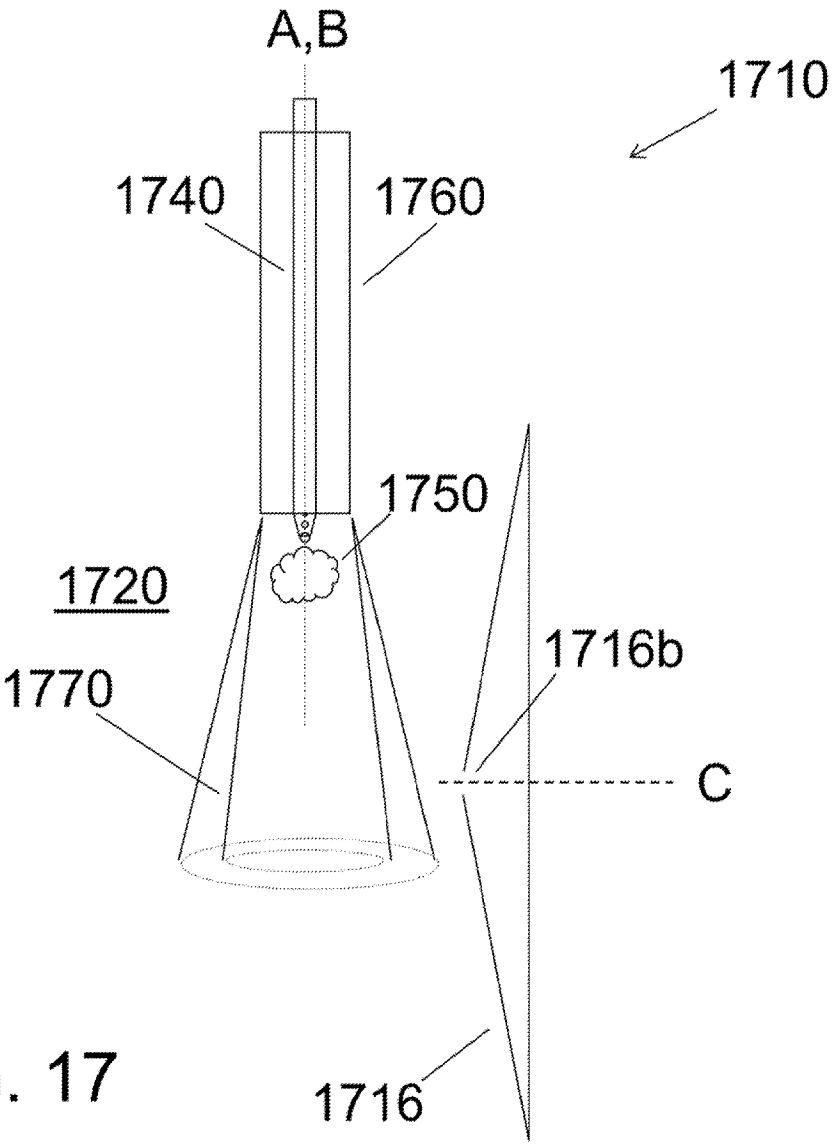
FIG. 17, in schematic diagram, illustrates an exemplary embodiment of a system for delivering a sample to a mass spectrometer.

FIG. 17 schematically depicts another embodiment of a system 1710 for delivering a sample to a mass spectrometer in which the sample source 1740 and the gas source 1760 for generating the steering gas stream 1770 are coaxial (e.g., the longitudinal axis (A) of the sample source 1740 is aligned with the longitudinal axis (B) of the steering gas source 1760). Further, as shown in FIG. 17, the longitudinal axes (A,B) can be orthogonal to the longitudinal axis (C) of the mass spectrometer containing the sampling orifice 1716*b* though other angles (e.g., non-orthogonal) are possible. Similar to the previous embodiments, the steering gas stream 1770 can form a conical flow that confines the sample plume 1750 and inhibits its expansion (e.g., dispersion) to a lower spatial concentration which could reduce the concentration of sample entering the mass spectrometer. Further, the steering gas stream 1770 can direct the sample along a central direction of the flow of the steering gas stream 1770, which in this case is perpendicular to the longitudinal axis (C) of the mass spectrometer. As the sample reaches the proximity of the orifice 1716*b*, at least a portion of the steering gas stream 1770 and the confined sample can be drawn into the sample orifice 1716*b*, e.g., via a pressure differential between a lower pressure region behind the orifice plate 1716 and the pressure of the region 1720 in front of the sampling orifice 1716*b* through which the steering gas stream 1770 is delivered.

In some embodiments, a lower flow rate of the steering gas stream 1770 can be employed due to the confinement provided by the faster moving shell. By way of example, the flow rate of the steering gas stream can be in a range of about 0.3 L/min to about 3 L/min.

Figure 18:
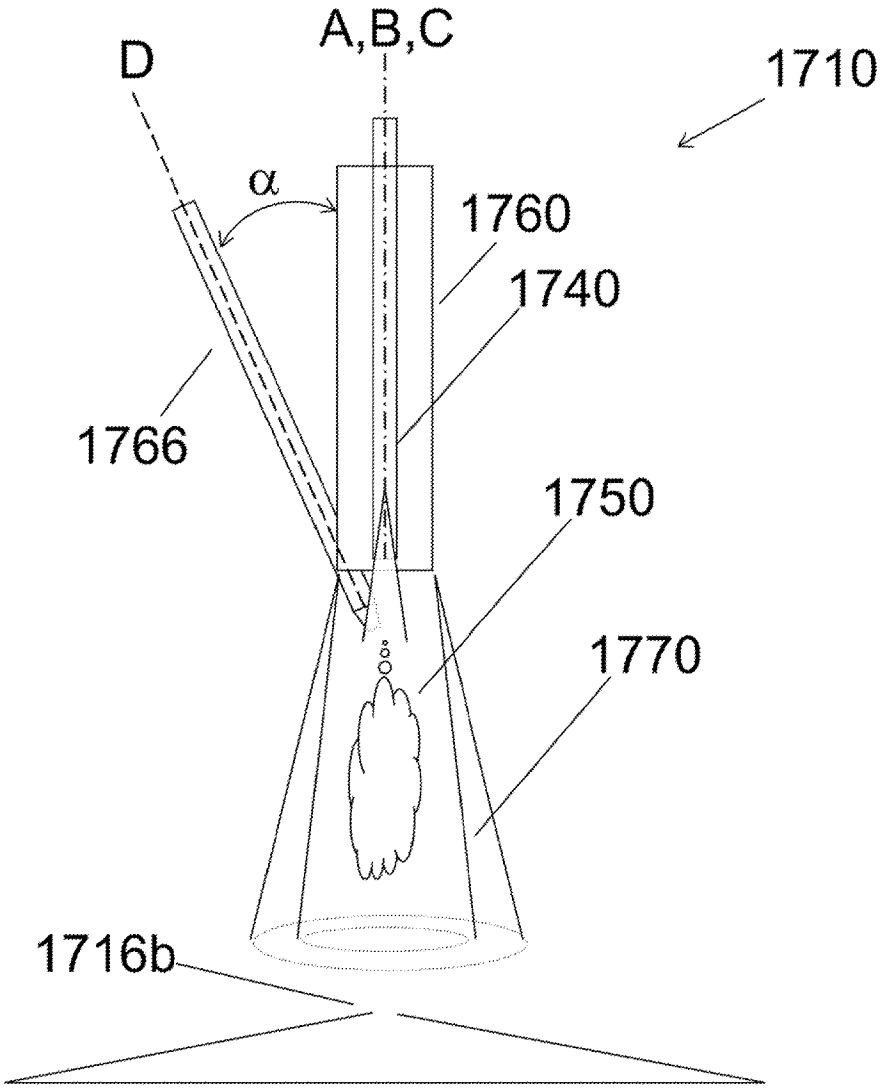
FIG. 18, in schematic diagram, illustrates a variant of the system of FIG. 17.

FIG. 18 schematically depicts an embodiment of a system 1710 for delivering a sample to a mass spectrometer similar to that shown in FIG. 17, but further including a secondary gas source 1766. The secondary gas source 1766 can provide an additional steering gas stream that can further direct the sample plume 1750 along the propagation corridor provided by the first steering gas stream 1770. As shown in FIG. 18, the tip 1766*a* of the secondary gas source 1766 can be positioned close to the central axis (B) of the conical flow generated by the primary gas source 1760. The longitudinal axis (D) of the secondary gas source 1766 can form an angle (α) relative to a longitudinal axis (B) of the primary gas source 1760. By way of example, the angle (α) can be in a range of about 0 degree to about 60 degrees.

In some embodiments, the confinement of the sample can be provided primarily by the first steering gas stream 1760. In any case, the two gas streams can cooperatively confine and steer the sample toward the sampling orifice 1716*b*. The plume can be confined along its perimeter with minimum mixing (dilution). In some cases, a low "on-axis" flow is needed to propel the plume toward the sampling orifice 1716*b*. By way of example, the primary gas source can be configured to provide a first steering gas stream 1760 at a flow rate in a range of about 0.3 L/min to about 3 L/min, while the secondary gas stream can be configured to provide a gas stream at a flow rate in a range of about 0.1 L/min to about 1.5 L/min.

While in the illustrated embodiment two separate gas sources 1760, 1766 provide the two steering gas streams, in other embodiments, a single gas source can be configured to provide two separate streams.

Figure 19:
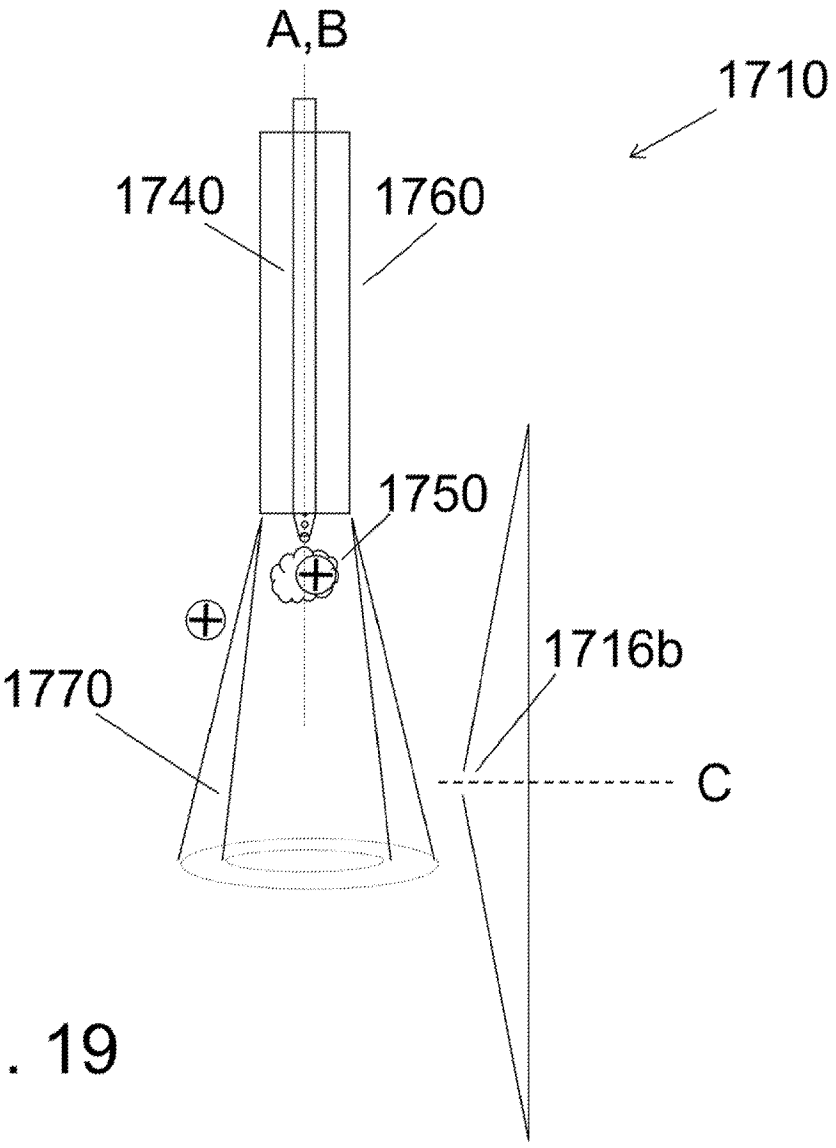
FIG. 19, in schematic diagram, illustrates a variant of the system of FIG. 17.

FIG. 19 schematically depicts another embodiment in which the gas source 1760 and the sample source 1740 are positioned coaxially relative to one another while orthogonal to the longitudinal axis (C) of the orifice plate. Similar to the embodiment of FIG. 14, the sample plume 1750 and/or the steering gas stream 1770 can include charges of the same or opposite polarities.

Figure 20:
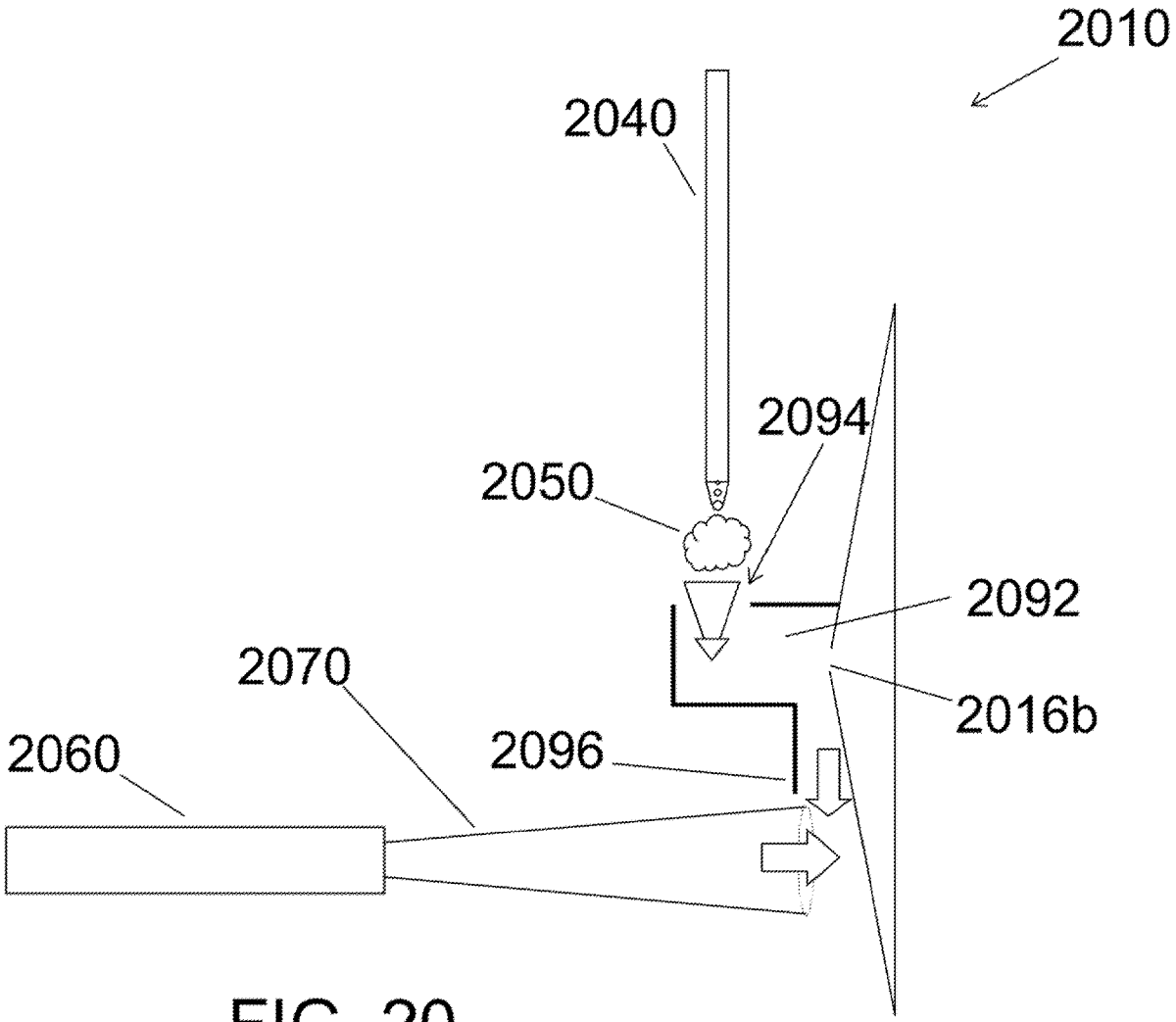
FIG. 20, in schematic diagram, illustrates an exemplary embodiment of a system for delivering a sample to a mass spectrometer.

FIG. 20 schematically depicts another embodiment of a system 2010 for directing a sample to a sampling orifice of a mass spectrometer, which includes a sample source 2040 for generating a zero (or low) velocity sample plume 2050. The system 2010 can include a venturi chamber 2092 in fluid communication with the sampling orifice 2016*b* of the mass spectrometer. The venturi chamber 2092 can include an input nozzle 2094 and an output nozzle 2096.

A gas source 2060 for generating a gas stream 2070 can be positioned such that the gas stream 2070 sweeps past the output nozzle 2096 of the venturi chamber 2092, thereby decreasing pressure within the venturi chamber 2092, e.g., to a pressure in a range of about static vacuum equivalent to about 0.1 cm to about 5 cm of water. In some embodiments, the flow rate of the gas stream 2070 is in a range of about 0.2 L/min to 20 L/min. By evacuating the venturi chamber 2092 based on the pressure differential between the input nozzle 2094 and the output nozzle 2096, the sample plume 2050 can be drawn into the venturi chamber 2092 via the input nozzle 2094 and across the face of the sampling orifice 2016*b*. At least a portion of the sample can enter the sampling orifice 2016*b*.

In some cases, the system 2010 depicted in FIG. 20 can minimize dilution of the sample as it is directed to the sampling orifice 2016*b* as a steering gas stream need not be mixed with the sample plume 2050 to propel the sample plume 2050 toward the sampling orifice 2016*b*. Rather, ambient air surrounding the zero velocity plume 2050 can move the sample into the venturi chamber 2092.

Those having ordinary skill in the art will appreciate that various changes can be made to the above embodiments without departing from the scope of the invention. All such modifications or variations are believed to be within the sphere and scope of the applicant's teachings as defined by the claims appended hereto.

The invention claimed is:

1. A system for directing a sample to a mass spectrometer comprising:

a sample source for generating an electrically neutral sample plume having a zero net velocity that is less than 1 cm/s, a venturi chamber in fluid communication with a sampling orifice of said mass spectrometer, said venturi chamber having an inlet port and an outlet port, said sample source being positioned relative to said inlet port of the venturi chamber so as to deposit the sample plume in proximity of said inlet port of the venturi chamber, and a gas source arranged to generate a gas flow in a direction so as to pass in proximity of said outlet port of the venturi chamber so as to cause a lowering of pressure within the venturi chamber, thereby drawing at least a portion of the sample plume through said inlet port into the venturi chamber such that at least a portion of the sample plume drawn into the chamber enters said sampling orifice.

2. The system of claim 1, wherein said gas flow has a flow rate in a range of about 0.2 L/min to about 20 L/min, and wherein said gas flow has an average flow velocity in a range of about 1 m/s to about 330 m/s.

3. A system for directing a sample to a mass spectrometer, comprising a sample source housing defining a source chamber, the source chamber configured to be in fluid communication with a sampling orifice of a mass spectrometer, a sample source for generating an electrically neutral sample plume having zero net velocity that is less than 1 cm/s along any particular direction, and a gas source for generating a steering gas flow in a first flow direction at a first flow rate such that the gas interacts with the sample plume to confine the sample plume, and a secondary gas source for generating a heated secondary gas flow along a second flow direction different from said first flow direction and at a second flow rate greater than said first flow rate, wherein said steering gas source and said secondary gas source are positioned relative to one another such that said steering gas flow intersects said secondary gas flow so as to generate a resultant gas flow propagating with a shape and along a trajectory defined to balance the exposure of the sample plume to the secondary gas flow with dispersion of the sample plume in the resultant gas flow;

wherein a minimum distance between an outlet port of the sample source and a longitudinal axis of said mass spectrometer is in a range of about 3 mm to about 50 mm, wherein a minimum distance between a longitudinal axis of the sample source and the sampling orifice is about 3 mm to about 8 mm, wherein a minimum distance between an output port of the secondary gas source and a putative plane orthogonal to a longitudinal axis of the mass spectrometer and containing the sampling orifice is in a range of about 10 mm to about 80 mm, and wherein a minimum distance between a longitudinal axis of the secondary gas source and said sampling orifice is in a range of about 0 mm to about 40 mm.

4. The system of claim 3, wherein said steering gas flow is directed substantially orthogonal to a longitudinal axis of the mass spectrometer.

5. The system of claim 4, wherein said resultant gas flow is directed across the sampling orifice.

6. The system of claim 3, wherein said sample source is configured to generate said sample plume via any one of a mechanical, an electromechanical, or a thermal evaporation mechanism.

7. The system of claim 6, wherein said sample source comprises any of a piezoelectric and a thermal nebulizer.

8. The system of claim 3, further comprising a pair of electrodes adjacent the sampling orifice, said pair of electrodes being configured to charge at least a portion of electrically neutral species contained in the portion of the sample plume that enters the sampling orifice.

9. The system of claim 3, wherein the sampling orifice is positioned on a longitudinal axis of said mass spectrometer.

10. The system of claim 3, wherein said secondary gas flow rate is at least about 5 times greater than said steering gas flow rate.

11. The system of claim 3, wherein said steering gas stream exits the sample source at a first average velocity and said secondary gas stream exits said gas source at a second average velocity, wherein said first average velocity is greater than said second average velocity.

12. The system of claim 11 wherein said first average velocity is at least about 8 times greater than said second average velocity.

13. The system of claim 3, wherein said resultant gas flow has a flow rate in a range of about 1 L/min to about 29 L/min.

* * * * *